US005619234A

United States Patent [19]

Nagato et al.

[11] Patent Number: 5,619,234

[45] Date of Patent: Apr. 8, 1997

[54] INK-JET RECORDING APPARATUS WHICH ALLOWS SHIFTING OR CHANGING OF INK POSITION OR DIRECTION

[75] Inventors: Hitoshi Nagato, Tokyo; Tsutomu Saito, Yokohama; Shuzo Hirahara, Yokohama; Tetuo Okuyama, Yokohama; Satoshi Takayama, Kawasaki; Sakae Tamura, Chiba; Shunsuke Hattori, Kawasaki; Hideki Nukada, Yokohama, all of Japan

[73] Assignee: Kabushiki Kaisha Toshiba, Kawasaki, Japan

[21] Appl. No.: 213,026

[22] Filed: Mar. 15, 1994

[30] Foreign Application Priority Data

Mar. 15, 1993 [JP] Japan ..... 5-080159
Mar. 15, 1993 [JP] Japan ..... 5-080162

[51] Int. Cl.[6] ..... B41J 2/065

[52] U.S. Cl. ..... 347/55; 347/13

[58] Field of Search ..... 347/12, 13, 33, 347/44, 48, 55, 46

[56] References Cited

U.S. PATENT DOCUMENTS 4,271,416 6/1981 Shimizu et al. ..... 347/55
4,794,463 12/1988 Tamura et al. ..... 347/55
5,126,765 6/1992 Nakamura ..... 347/33

FOREIGN PATENT DOCUMENTS 49-62024 6/1974 Japan .
60-250962 12/1985 Japan .
1-108354 7/1989 Japan .

*Primary Examiner*—Joseph W. Hartary
*Attorney, Agent, or Firm*—Oblon, Spivak, McClelland, Maier & Neustadt, P.C.

[57] ABSTRACT

An ink-jet recording apparatus which includes a recording medium for carrying an electrostatic image, an ink-ejecting section opposing the recording medium and located in non-contact state with respect to the recording medium medium, and having an ink holding section for holding ink and an opening section for ejecting ink, at least one counter electrode located in the ink-ejecting section to be immersed in ink. The ink is ejected by virtue of an electric field between the electrostatic image formed on the recording medium and the counter electrode.

23 Claims, 20 Drawing Sheets

INK-JET RECORDING APPARATUS WHICH ALLOWS SHIFTING OR CHANGING OF INK POSITION OR DIRECTION

BACKGROUND OF THE INVENTION

1. Field of the Invention

The present invention relates to a recording apparatus for printing various types of data, and more particularly, to an ink-jet recording apparatus.

2. Description of the Related Art

So-called "ink-jet recording method" is known, in which droplets of liquid ink are ejected onto a recording medium, thereby forming dots thereon.

The ink-jet recording method accomplishes data recording, making less noise than other recording methods. Furthermore, the method does not involve such processes as development and fixing. Because of these advantages, the ink-jet recording method has received a great deal of attraction as technique of recording data on plain paper.

Various ink-jet recording methods have been devised and disclosed. Among them is so-called "slit jet recording method," in which a number of recording electrodes juxtaposed along an ink-ejecting slit are used to control the ejection of ink droplets. The slit jet recording method is regarded as desirable, since it achieves high-speed recording and scarcely cause ink clogging.

An electrostatic acceleration ink-jet recording apparatus is known which performs the slit jet recording method. This recording apparatus comprises an ink-ejecting slit having a width of about 100 μm and a length of about 200 mm, a number of recording electrodes juxtaposed in the slit in such a density of about 8 pieces/mm, and means for applying high-voltage pulses to those of the recording electrodes which have been selected in accordance with the data to be recorded on a recording medium. Those portions of ink which are located near the selected recording electrodes applied with high voltage are attracted to back electrodes by virtue of electrostatic force. As a result, ink dots are formed on a recording member located between the ink-ejecting slit and back electrode, whereby data is recorded on the recording member.

A method of applying high-voltage pulses on the selected ones of the many recording electrodes is known, in which the recording electrodes are connected to high-voltage pulse generating circuits, respectively, and the pulse generating circuits are selectively driven in accordance with data to be recorded on a recording member. To effect this method, it is necessary to use as many high-voltage pulse generating circuits as the recording electrodes. The ink-jet recording apparatus, which employs this pulse-applying method is inevitably large and expensive, and thus not so practical.

In recent years, a new ink-jet recording method has been proposed (Jpn. Pat. Appln. KOKAI Publication No. 60-250962). In this method recording electrodes are connected to a first high-voltage applying electrode by photoconductive insulators of the recording electrodes and also to second high-voltage applying electrodes by fixed resistors, respectively. While a high DC voltage is applying between the recording electrodes and second high-voltage applying electrode, optical signals corresponding to data to be recorded are applied to the photoconductive insulators, thereby changing the potentials of the recording electrodes in accordance with the data.

This method utilizes the fact that a photoconductive insulator has its resistances varied in accordance with the amount of light it receives. With this method, however, it is impossible to change the potentials of the recording electrodes greatly enough, and it is difficult to control ejection of ink. This is because the photoconductive insulator interposed between the first high-voltage applying electrode and each recording electrode, and the fixed resistor interposed between each recording electrode and the corresponding second high-voltage applying electrode have a limited withstand voltage.

The above-described method applying high-voltage pulses to the selected ones of many recording electrodes has a problem other than that indicated above. The other problem is electric field interference between any adjacent recording electrodes (The Transactions of the Institute of Electronics, Information and Communication Engineers, Vol. J66-C, No. 1, p. 48, January 1983). In order to eliminate the interference, a voltage cannot be applied on the adjacent recording electrodes at the same time. It is necessary to apply a high-voltage pulse to every other recording electrode, every two other recording electrodes, or so, thereby performing split driving. The printing speed will inevitably decrease. In addition, petroleum-based, high-resistance ink must be used to prevent a current leakage through the ink filled in the gaps among the recording electrode. Due to such a current leakage, changes the physical properties of the ink, particularly the resistance change caused by a temperature change, would greatly vary the ejection characteristic of the ink. The narrower the gaps among the recording electrodes, the more prominent the current leakage. It is difficult to arrange more recording electrodes over a unit distance. That is, it is difficult to increase the density of the electrodes. High fidelity recording that can be attained by the slit jet recording method is inevitably limited.

The ink-jet recording apparatus, which is increasing in personal use, is of serial type which applies pressure on parts of ink in accordance with image signals, thereby ejecting ink droplets from an array of tiny nozzles.

The greatest problem with the ink-jet recording method of this is type that it is necessary to limit the number of tiny nozzles in practice due to ink clogging which may occur when the ink dries in the tiny nozzles. Ink clogging impairs the reliability of the ink-jet head is impaired. Thus it is much demanded that an elongated line head having high reliability be developed for the ink-jet recording method.

To solve the problem, various ink-jet recording methods have been proposed. Among these methods are: solid-state ink-jet method, wherein ink which remains solid at ordinary temperature is heated, melted and ejected through an array of tiny nozzles under pressure generated in accordance with image signals; thermal ink-jet method, wherein a thermal head heats a porous film containing ink, thereby ejecting the ink from the film; and above mentioned slit jet method (Jpn. Pat. Appln. KOKAI Publication No. 49-62024), electrostatic attraction is applied to ink, thereby ejecting the ink through a common ejection slit toward a common electrode, by using electrostatic attraction.

A requirement which the ink-jet recording method needs to meet is to record images at high resolution. Generally, high-resolution printing must be attained in order to reproduce a curved-line image with fidelity. The ink-jet recording reproduces images having a resolution of about 300 dpi, whereas electrophotography, which is widely used in offices, provides images having a resolution of 800 dpi. Obviously, ink-jet recorded images are inferior in quality to electrophotographed images. To raise the resolution of the ink-jet recording, nozzles must be arranged in a higher density.

However, nozzles cannot be arranged so densely with the existing manufacturing technology, without degrading the reliability of the ink-jet head. As a matter of fact, the recording method has yet to achieve a sufficiently high resolution.

SUMMARY OF THE INVENTION

An object of the present invention is to provide a recording apparatus which requires no high-voltage pulse generating circuit including expensive ICs having a high withstand voltage.

Another object of this invention is to provide an electrostatic ink-jet recording apparatus which can easily control ink ejection, which operates, scarcely influenced by the type of ink or changes in the physical properties of ink, and which can record data in high density.

Still another object of the present invention is to provide an ink-jet recording apparatus which is free of ink clogging which may result from drying of ink, which has so high a resolution as to print smooth curved lines.

According to a first aspect of the invention, there is provided a recording apparatus which comprises: a recording medium for carrying a latent image; a developing member opposing the recording medium, for holding developer and supplying the developer to a recording member; and developer-moving means for moving the developer from the developing member toward the recording medium.

According to a second aspect of the invention, there is provided a recording apparatus which comprises: an ink-holding section, for holding at least one type of ink, having a common opening section; a plurality of pixel electrodes located in the ink-holding section and juxtaposed along the common opening section, for ejecting ink; at least one common electrode opposing the common opening, for imparting a potential difference to the pixel electrodes; and means for controlling the potential of each of the pixel electrodes to shift an ink-ejection position along the common opening section or to change an ink-ejection direction along the common opening.

According to a third aspect of the invention, there is provided a recording apparatus which comprises: an ink-holding section, for holding at least one type of ink, having a common opening section; a plurality of pixel electrodes located in the ink-holding section and juxtaposed along the common opening section, for ejecting ink; at least one common electrode opposing the common opening section, for imparting a potential difference to the pixel electrodes; a plurality of auxiliary electrodes located between the common opening section and the common electrode and arranged such that at least one corresponds to one pixel electrode, for an independent potential difference to each of the pixel electrodes; and means for controlling the potential of each of the pixel electrodes to shift an ink-ejection position along the common opening section or to change an ink-ejection direction along the common opening.

According to a fourth aspect of the invention, there is provided a recording apparatus which comprises: an ink-holding section, for holding at least one type of ink, having a common opening, section; a plurality of pixel electrodes located in the ink-holding section and juxtaposed along the common opening section; at least one common electrode opposing the common opening section, for imparting a potential difference to the pixel electrodes; and a plurality of auxiliary electrodes located between the common opening section and the common electrode and arranged such that at least one corresponds to one pixel electrode, for an independent potential difference to each of the pixel electrodes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
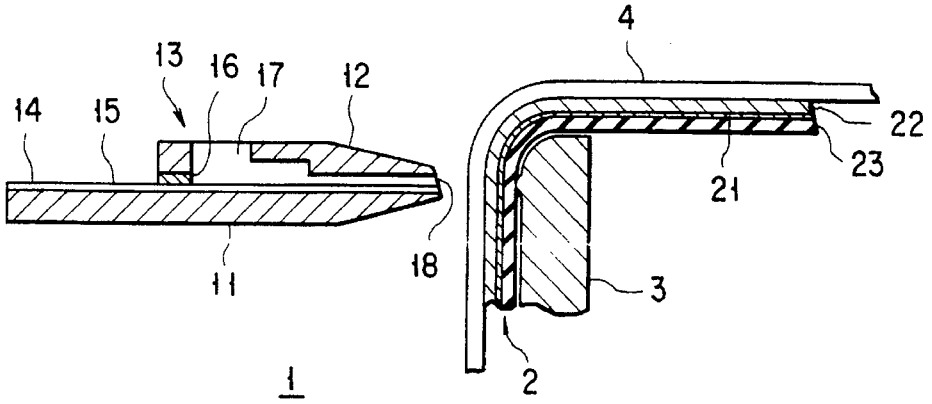
FIG. 1 is a sectional view showing an embodiment ink-jet recording apparatus according to a first aspect of the present invention.

The present invention will be described in detail, with reference to the accompanying drawings.

A recording apparatus according to the first aspect of the invention comprises a recording medium for carrying a latent image, a developing member opposing the recording medium, for holding developer and supplying the developer to a recording member, and developer-moving means for moving the developer from the developing member toward the recording medium.

A typical embodiment of this apparatus comprises a recording medium for carrying an electrostatic latent image, an ink-ejecting section opposing the recording medium, spaced away therefrom, and having a port for holding developer and ejecting ink, and at least one counter electrode located in the ink-ejecting section and, hence, immersed in the ink held in that section, wherein ink is ejected from the port, by virtue of an electric field generated between an electrostatic latent image formed on the recording medium and the counter electrode.

In the case where the recording apparatus according to the first aspect of the present invention is designed to effect ink-jet recording, an electrostatic latent image on the recording medium determines whether to eject ink or not. Thus, it is unnecessary to apply high-voltage pulses to the counter electrodes immersed in the ink, respectively, and it is possible to apply pulse voltage to all counter electrodes at the same time. The apparatus requires no high-voltage pulse generating circuit, and can yet record data in high fidelity. In addition, difficulty does not involve in controlling ink ejection, as in the conventional apparatus using a photoconductive insulator.

In the first aspect of the present invention, a recording member to which developer (ink droplets) will ultimately applied to record data is located between the recording medium and the developing member (the ink-ejecting section). Therefore, data can be recorded directly on a recording member by applying developer (ink droplets) onto the recording member. Alternatively, data can be recorded indirectly on the recording member, first by applying the developer to the recording medium and then by transferring the developer from the medium to the recording member.

In any ink-jet recording apparatus according to the first aspect of the present invention, its ink-ejecting section can be of any one of the types which hitherto have been incorporated in electrostatic acceleration ink-jet recording apparatuses. Needless to say, use can be made of a single-nozzle ejecting unit which is the simplest of all types known. A slit-jet nozzle unit which has a slit and a plurality of electrodes mounted on the inner surface of the slit can also be used without connecting a pulse-generating circuit to each electrode.

A more advanced recording apparatus according to the first aspect is provided, which has a recording medium designed to carry an electrostatic latent image, which comprises an back electrode and a pyroelectric layer laid on the back electrode. When the recording medium is heated, an electrostatic latent image is formed on the pyroelectric layer. Thereafter, a DC or AC bias voltage is applied to the back electrode, thus recording data on the recording member.

The electrostatic latent image on the recording medium must have a sufficiently high potential to stabilize the ink ejection. Since the recording medium includes a pyroelectric layer, the latent image can easily acquire a potential as high as several tens of volts to 2000 V when the pyroelectric layer is heated. It is therefore unnecessary to use a high voltage source for the purpose of forming an electrostatic latent image.

A dielectric layer may be interposed between the back electrode and the pyroelectric layer in the recording medium, so as to raise the apparent potential of the back electrode. It is also possible to form on the pyroelectric layer a floating electrode layer which comprises a dielectric matrix and fine metal particles contained in the dielectric matrix and insulated from one another.

The pyroelectric layer can be formed of pyroelectric resins such as vinylidene polyfluoride, a copolymer of vinylidene fluoride and trifluoroethylene, a copolymer of vinylidene fluoride and tetrafluoroethylene, and a copolymer of vinylidene cyanide and another monomer. Alternatively, the pyroelectric layer can be formed of pyroelectric ceramics such as PZT ($Pb_2ZrO_3$, $PbTiO_3$) ceramics and PLZT ($Pb_2ZrO_3$, $PbTiO_3$, $La_2O_3$) ceramics, and inorganic pyroelectric crystalline materials such as $BaTiO_3$, $LiTaO_3$, $LiNbO_3$ and quartz. Sill alternatively, the pyroelectric layer can be made of pyroelectric material obtained by dispersing powder of organic pyroelectric crystalline material, such as Rochelle salt or triglycine sulfate in a thermoplastic resin or a thermosetting resin. Made any one of these alternative materials, the pyroelectric layer is changed into electorates by means of polarization such as poling, or has its direction of spontaneous polarization oriented, so that the recording medium may perform its function.

In another embodiment of the recording apparatus according to the first aspect of the invention, the recording medium for carrying an electrostatic latent image comprises a back electrode and a photosensitive layer laid upon the back electrode. Light is applied to the recording medium, forming an electrostatic latent image on the photosensitive layer, and then a DC or AC bias voltage is applied on the back electrode, thereby recording data.

When a photoconductive insulator is used as a recording medium, it is possible to employ the known electrophotography method of forming an electrostatic latent image on a photosensitive body, and to utilize all components and materials used in an apparatus for effecting that method.

Furthermore, it is useful to use a photosensitive body which is formed of a photoconductive layer and a transparent insulting layer arranged upon the photoconductive layer. The transparent insulating layer helps to keep clean the surface of the photosensitive body.

The recording systems which the conventional electrostatic acceleration ink-jet recording apparatuses perform are classified into two types, namely, on-demand type and continuous type. In the on-demand type, a pulse voltage is applied on the electrodes provided in the ink-ejecting section only while data is being be recorded. In the continuous type, a voltage is periodically applied on the electrodes provided in the ink-ejecting section, thereby successively ejecting ink droplets, and the ink droplets are deflected by deflection electrodes to a recording member or into a gutter and thus collected into an ink tank.

By contrast, in the ink-jet recording apparatus applied to the first aspect of the invention, it is the electrostatic latent image on the recording medium that determines whether to eject ink or not. It is therefore unnecessary to apply high-voltage pulses to the respective counter electrodes immersed in the ink held in the ink-ejecting section. This makes it possible to apply pulse voltage to all counter electrodes simultaneously. No high-voltage pulse generating circuit is required, greatly simplifying the structure of the ink-ejecting section. Thus, it is easy to manufacture the ink-ejecting section which is required many electrodes such as a slit nozzle. Therefore, ink clogging problem which is an inherent problem of the ink-jet recording method can easily be dissolved by using a slit set nozzle which hardly generate ink clogging. Since all counter electrodes are set at the same potential, the ink-ejecting section involves no interference between the electrodes which is a problem with the slit jet recording method.

No current leaks from one electrode to any adjacent electrode through the ink. Therefore, water ink can be used in the ink-jet recording apparatus of this invention, in place of oil based ink which is electrically insulating and which is necessarily used in the connectional slit jet recording apparatus. Use of water ink is preferable, since it does not contain, unlike the oil ink, any petroleum-based solvent which pollute air and water and which is inflammable and may cause a fire.

Also, it is possible with the first aspect of the invention to apply to the counter electrodes of the ink-ejecting section, not only pulse voltage, but also a bias voltage obtained by superposing an AC voltage and an AC voltage. The ink is thereby vibrated electrically and readily forms a meniscus. The data-recording speed can, therefore, be enhanced.

Various embodiments according to the first aspect of the present invention will now be described in detail.

Embodiment 1

Figure 2:
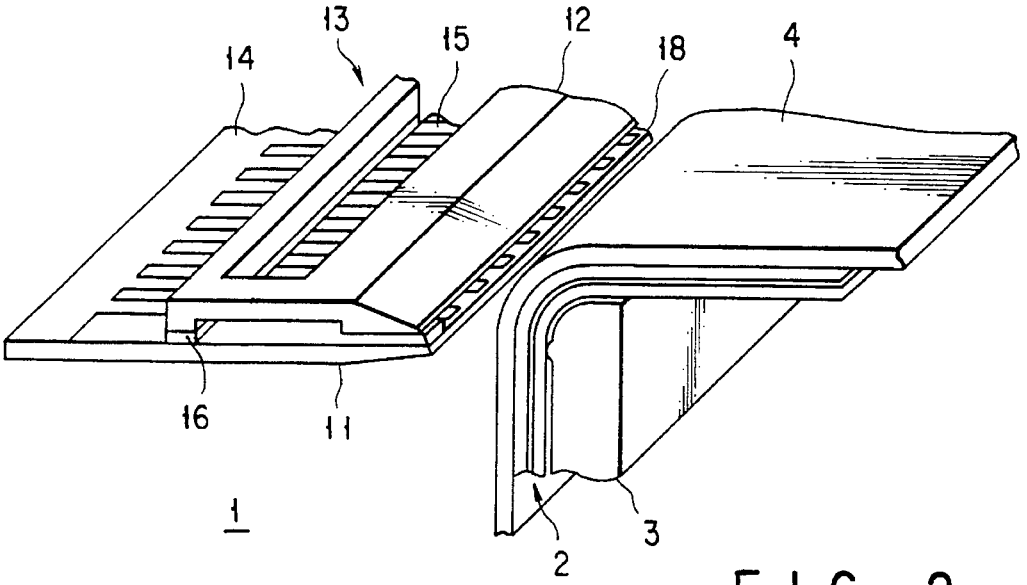
FIG. 2 is a perspective view of the apparatus shown in FIG. 1.

FIG. 1 is a sectional view showing the main portion of an ink-jet recording apparatus which is a this embodiment. FIG. 2 is a perspective view of that portion of the recording apparatus. As shown in FIGS. 1 and 2, the ink-jet recording apparatus comprises an ink-ejecting section 1 and a recording medium 2.

The ink-ejecting section 1 comprises a substrate 11 and an upper plate 12. These components 11 and 12 constitute an ink-holding section 13 for containing ink. The distal end of the section 13 has an ink-ejecting slit 18.

A common electrode 14 and a plurality of counter electrodes 15 are arranged on the substrate 11. The counter electrodes 15 was formed by depositing chromium on the substrate 11 by way of vacuum vapor evaporation and etching the distal end portion of the resultant chromium layer in a prescribed pattern. They have a length of 5 mm and a width of 60 μm, and are arranged in a density of about 8 pieces/mm. The proximal end portion of the chromium layer, which has not been etched, is the common electrode 14 to which a high voltage is to be applied in operation. In the this embodiment, amorphous silicon nitride film has been deposited on each electrode by plasma CVD (Chemical Vapor Deposition), and prevents the electrode from being corroded. The substrate 11 and the upper plate 12 are firmly bonded together, with a spacer 16 interposed between them, thus constituting the ink-ejecting section 1 having the ink-holding section 13.

In operation, the ink-holding section 13 was filled with water ink 17 which had been from the above. The water ink had electrical conductivity of 0.06 (1/Ω.m) and viscosity of $1.75\times10^{-3}$ ($m^2/s$).

The recording medium 2, which is used to carry an electrostatic latent image, comprises a back electrode 21, a pyroelectric layer 22 laid on the back electrode 21, and a dielectric layer 23 laid on the pyroelectric layer 22. The pyroelectric layer 22 was 8 μm thick; it was a composite material formed of $LiTaO_3$ and vinylidene polyfluoride and having pyroelectric coefficient of 12 $nC/cm^2.K$. The back electrode 21 was an aluminum plate having a thickness of 100 μm. The dielectric layer 23, used as a protective film, was made of polyethylene terephthalate and has a thickness of 3.5 μm.

A recording head 3 is located, opposing the ink-ejecting section 1 of the recording medium 2. In this embodiment, the head 3 was a thermal head for carrying out thermal printing in density of 200 dpi.

In operation, a recording member 4 was fed forward in sliding contact with the recording medium 2, while data was being recorded on it. The member 4 was a smooth recording paper sheet having a thickness of 60 μm.

In operation the recording head 3 heated the recording medium 2, at recording cycle of 1 msec and pulse width of 0.3 msec. The voltage applied on the surface of the pyroelectric layer 22, i.e., the surface layer of the recording medium 2, increased a potential peak of 700 V with respect to the back electrode 21. A DC bias voltage of 300 V was applied on the back electrode 21.

The ink-ejecting section 1 was so positioned that the counter electrodes 15 are spaced by 500 μm from the tip of the recording head 3. Then, a pulse voltage of 300 V of the reverse polarity was superposed upon a DC voltage of 200 V which was of the same polarity. The resultant voltage was applied to the common electrode 14 in synchronization with the pulse-voltage applying signals supplied to the recording head 3. Ink droplets were ejected through the ink-ejecting slit 18 toward the surface of the recording medium, on which a latent image had been formed. Thus it was confirmed that data was actually recorded on the recording member 4 (i.e., the recording paper sheet) which contacted the recording medium 2.

Embodiment 2

Figure 3:
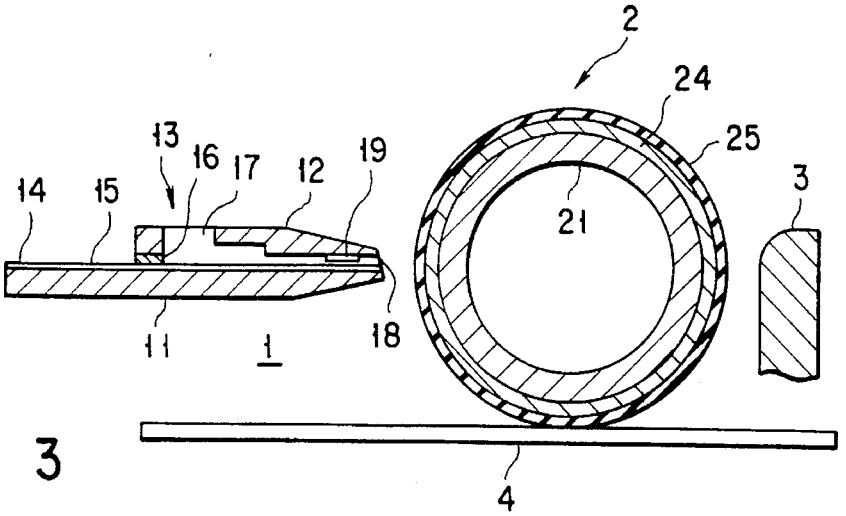
FIG. 3 is a sectional view illustrating another type of the ink-jet recording apparatus according to the first aspect of present invention.
Figure 4:
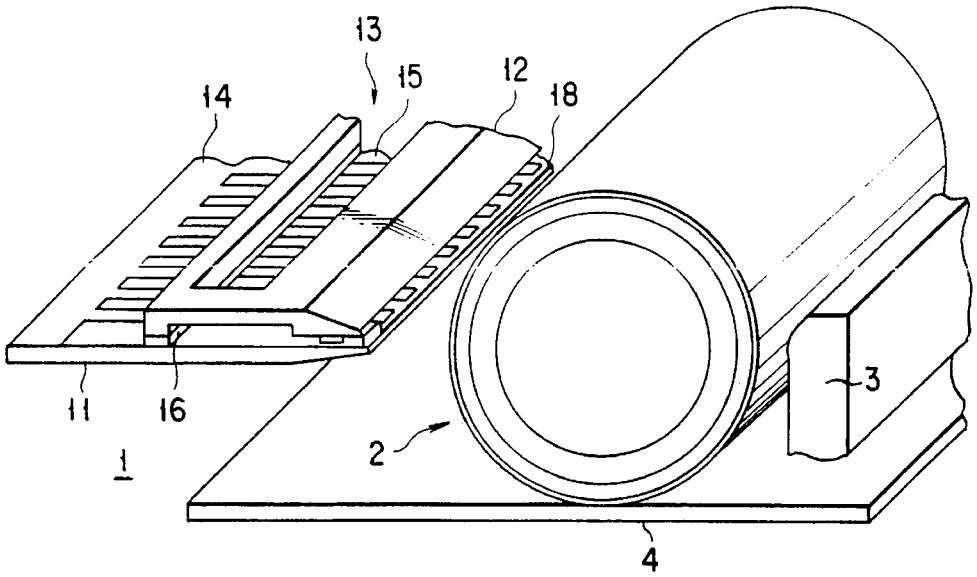
FIG. 4 is a perspective view of the apparatus shown in FIG. 3.

FIG. 3 is a sectional view showing the sectional view of main portion of an ink-jet recording apparatus of this embodiment. FIG. 4 is a perspective view of that portion of the recording apparatus. As shown in FIGS. 3 and 4, the ink-jet recording apparatus comprises an ink-ejecting section 1 and a recording medium 2, too.

The ink-ejecting section 1 is identical in structure to its counterpart of Embodiment 1. That is, the ink-ejecting section 1 comprises a substrate 11 and an upper plate 12, which constitute an ink-holding section 13 for containing ink. The distal end of the section 13 has an ink-ejecting slit 18.

A common electrode 14 and a plurality of counter electrodes 15 are arranged on the substrate 11. The counter electrodes 15 is formed by the same method, and have the same size and the same shape, as those of Embodiment 1.

A electrode 19 is laid on the substrate 11, for applying a high voltage. The electrode 19 crosses the counter electrodes 15; it is formed in the same way as the counter electrodes 15. Also in this embodiment, amorphous silicon nitride film is deposited on each electrode by plasma CVD; it prevents the electrode from being corroded. The substrate 11 and the upper plate 12 are firmly bonded together, with a spacer 16 interposed between them, thus constituting the ink-ejecting section 1 having the ink-holding section 13.

The ink-holding section 13 was filled with oil based ink 17 which had been poured from above. This ink which had electrical conductivity of $6\times10^{-8}$ (1/Ω.m) and viscosity of $0.90\times10^{-6}$ ($m^2/s$).

The recording medium 2, which is designed to carry an electrostatic latent image, is a hollow cylinder. It comprises a hollow cylindrical back electrode 21, a photosensitive layer 24 made of photoconductive insulating material and wrapped around the outer circumferential surface of the back electrode 21, and a dielectric layer 25 laid on the photosensitive layer 24.

In this embodiment, the photosensitive layer 24 was 40 μm thick and made of a composite material formed of CdS and polyester. The back electrode 21 was an aluminum plate having a thickness of 100 μm. The dielectric layer 25, functioning as a protective film, was made of transparent polyethylene terephthalate and had a thickness of 25 μm.

A recording head 3 is located, opposing the ink-ejecting section 1 of the recording medium 2. In this embodiment, the head 3 was an LED head for performing electrophotographic recording in density of 300 dpi.

In this embodiment, the ink-ejecting section 1 applies ink onto the recording medium 2, thereby forming an ink image which corresponds to an electrostatic latent image formed on the recording medium 2. The ink image is transferred from the recording medium 2 onto a recording member 4 which is being fed forward in sliding contact with the recording medium 2. The recording member 4 was a smooth recording paper sheet having a thickness of 60 μm.

In operation, the surface of the dielectric layer 25 is positively charged. Next, the recording head 3 radiates a light onto the recording medium 2. The outer circumferential surface of the medium 2 is subjected to exposure for image forming, whereby an electrostatic latent image is formed on that surface of the recording medium 2.

In this embodiment the recording medium was irradiated with light at recording cycle of 2 msec and pulse width of 0.5 msec. The voltage applied on the surface of the dielectric layer 25 at the time of forming the electrostatic latent image was a potential peak of 1300 V with respect to the back electrode 21.

The ink-ejecting section 1 was so positioned that the counter electrodes 15 are spaced by 500 μm from the tip of the recording medium 2. An AC bias voltage having a wave height of 50 V and a frequency of 4 kHz was applied on the electrode 19 of the ink-ejecting section 1. As a result, an electrostatic impact was applied on the ink. Then, a pulse voltage of 300 V of the reverse polarity was applied as a bias voltage on the common electrode 14 used for applying a high voltage, in synchronization with the pulse-voltage applying signals supplied to the recording head 3. As a result of this, ink droplets were ejected through the ink-ejecting slit 18 toward the surface of the recording medium, on which a latent image had been formed. Thus it was confirmed that data was actually recorded on the recording member 4.

Embodiment 3

Figure 5:
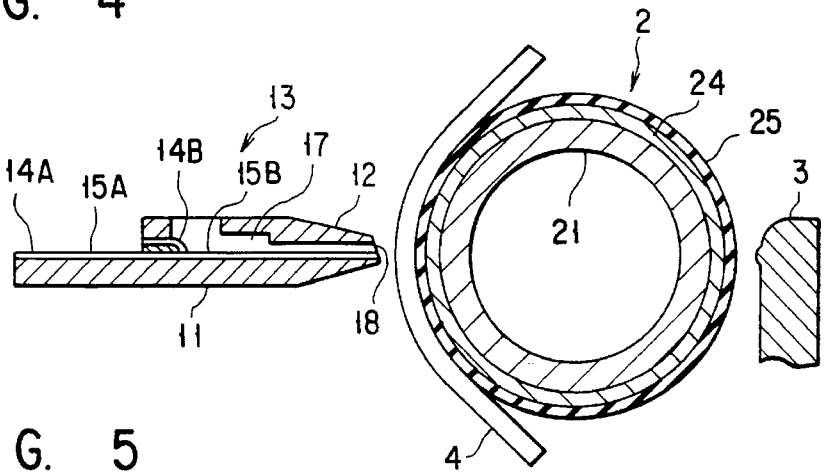
FIG. 5 is a sectional view representing still another type of the ink-jet recording apparatus according to the first aspect of the present invention.
Figure 6:
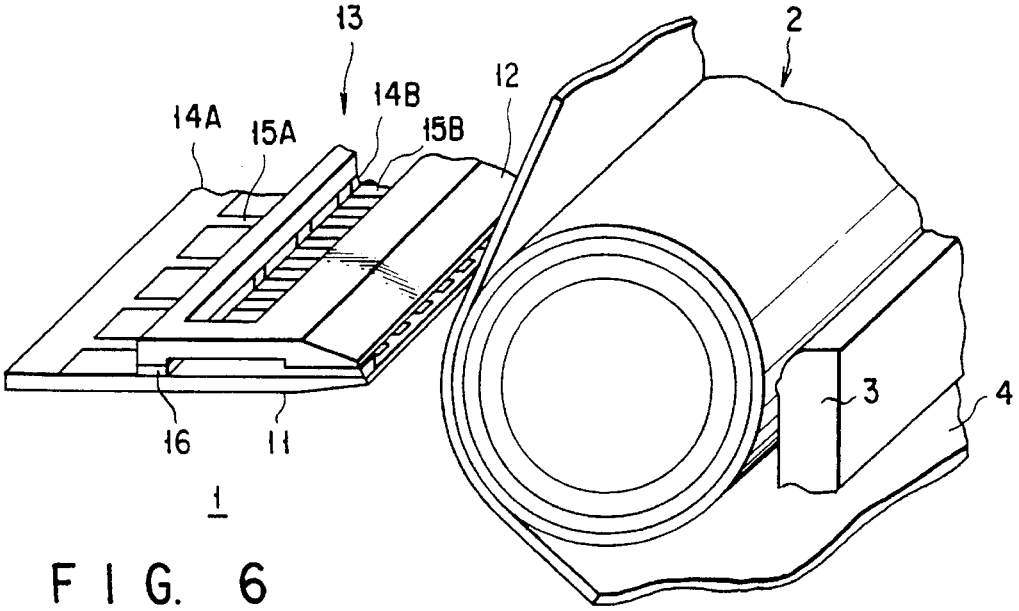
FIG. 6 is a perspective view of the apparatus illustrated in FIG. 5.

FIG. 5 is a sectional view showing the main portion of an ink-jet recording apparatus which is this embodiment, and FIG. 6 is a perspective view of that portion of the recording apparatus. As shown in FIGS. 5 and 6, the ink-jet recording apparatus comprises an ink-ejecting section 1 and a recording medium 2, too.

The ink-ejecting section 1 is identical in structure to its counterpart of Embodiment 1. That is, the section 1 comprises a substrate 11 and an upper plate 12, which constitute an ink-holding section 13 for containing ink. The distal end of the section 13 has an ink-ejecting slit 18.

A set of counter electrodes 15A and another set of counter electrodes 15B are arranged on the substrate 11. In addition, a common electrode 14A is provided on the substrate 11. The common electrode 14 is connected to the counter electrodes 15A. Moreover, another common electrode 14B is arranged partly on the substrate 11 and partly on a spacer 16 which is laid on the substrate 11. The counter electrodes 15A and 15B was formed, first by depositing chromium on the substrate 11 by way of vacuum vapor evaporation, and then by etching the middle portion of the resultant chromium layer in a prescribed pattern. The electrodes 15A and 15B have a width of 60 μm and are alternately arranged in a density of about 8 pieces/mm. The end portions of the chromium layer, which have not been etched, are the common electrodes 14A and 14B. In this embodiment, too, an amorphous silicon nitride film has been deposited on each electrode by plasma CVD, and prevents the electrode from being corroded.

The substrate 11, having the common electrodes 14A and 14B and the counter electrodes 15A and 15B arranged on it, and the upper plate 12 was firmly bonded together, with a spacer 16 interposed between them, thus constituting the ink-ejecting section 1 having the ink-holding section 13.

The ink-holding section 13 was filled with oil based ink 17 which had been poured from above. The oil based ink had electrical conductivity of $1.1\times10^{-8}$ (1/Ω.m) and viscosity of $1.85\times10^{-6}$ ($m^2/s$).

The recording medium 2, which is designed to carry an electrostatic latent image, is a hollow cylinder. It comprises a hollow cylindrical back electrode 21, a photosensitive layer 24 made of photoconductive insulating material and wrapped around the outer circumferential surface of the back electrode 21, and a dielectric layer 25 laid on the photosensitive layer 24.

In this embodiment, photosensitive layer 24 was 1 μm thick and made of n-type hydrogenated amorphous silicon. The back electrode 21 was an aluminum plate having a thickness of 1 mm. The dielectric layer 25, functioning as a protective film, was made of transparent polyethylene terephthalate and has a thickness of 25 μm.

A recording head 3 is located, opposing the ink-ejecting section 1 of the recording medium 2. In this embodiment, the head 3 was an LED head for effecting electrophotographic recording in density of 300 dpi.

Unlike in Embodiment 2, this embodiment perform direct recording. Therefore, a recording member 4 is wrapped around the recording medium 2 so that the ink-ejecting section 1 may ejects ink droplets directly onto the recording member 4, thereby to record data thereon. The recording member 4 was a smooth recording paper sheet having a thickness of 60 μm.

In operation, the surface of the dielectric layer 25 is positively charged. Then, the recording head 3 radiate a light onto the recording medium 2. The outer circumferential surface of the medium 2 is subjected to exposure for image forming, whereby an electrostatic latent image is formed on that surface of the recording medium 2.

In this embodiment, the recording medium was irradiated with light at recording cycle of 1 msec and pulse width of 0.5 msec. The voltage applied on the surface of the dielectric layer 25 at the time of forming the electrostatic latent image was a potential peak of 1500 V with respect to the back electrode 21.

The ink-ejecting section was so positioned that the counter electrodes 15A and 15B are spaced by 500 μm from the tip of the recording medium 2. An AC bias voltage having a wave height of 30 V and a frequency of 4 kHz was applied on the common electrode 14A, and an AC bias voltage having the same wave height and the same frequency was applied to the common electrode 14B with a phase difference of 180°. An electrostatic impact was thereby applied on the ink. Then, pulse voltages of 300 V of the reverse polarities were applied to the common electrodes 14A and 14B, respectively, in synchronization with the pulse-voltage applying signals supplied to the recording head 3. As a result, ink droplets were ejected through the ink-ejecting slit 18 toward the surface of the recording medium, on which a latent image had been formed. Thus it was confirmed that data was actually recorded on the recording member 4.

Embodiment 4

Figure 7:
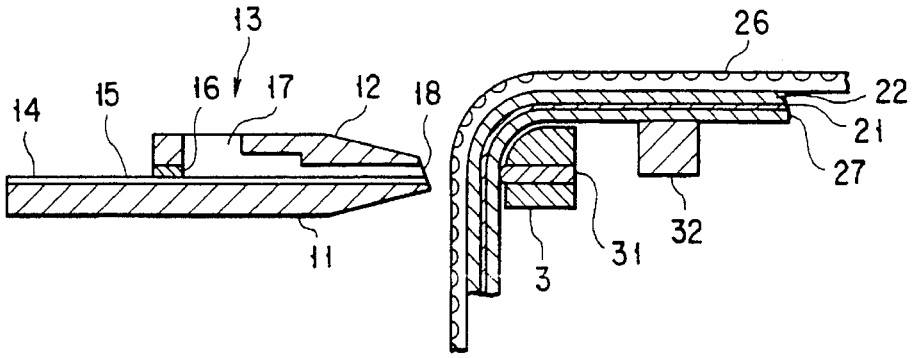
FIG. 7 is a sectional view showing even another type of the ink-jet recording apparatus according to the first aspect of this invention.

FIG. 7 is a sectional view showing the main portion of an ink-jet recording apparatus of this embodiment. This apparatus is designed to carry out serial-type ink-jet recording method. As seen from FIG. 7, the apparatus comprises an ink-ejecting section 1 and a recording medium 2, like the embodiments described above.

The ink-ejecting section 1 is similar in structure to its counterpart of Embodiment 1. It comprises a substrate 11 and an upper plate 12. These components 11 and 12 constitute an ink-holding section 13 for containing ink. The distal end of the section 13 has an ink-ejecting slit 18. A common electrode 14 and counter electrodes 15 are arranged on the substrate 11. These electrodes 14 and 15 are made of metal chromium. The counter electrodes 15 had width of 60 μm and were arranged in a density of about 8 pieces/mm. In this embodiment, amorphous silicon nitride film was deposited on the counter electrodes 15 by plasma CVD, thereby preventing the electrodes 15 from being corroded.

The substrate 11 and the upper plate 12 were firmly bonded together, with a spacer 16 interposed between them, thus constituting the ink-ejecting section 1 having the ink-holding section 13.

The ink-holding section 13 was filled with oil based ink 17 which had been poured from the above. The oil based ink had electrical conductivity of $1.8\times10^{-7}$ (1/Ω.m) and viscosity of $5.5\times10^{-6}$ ($m^2/s$).

The recording medium 2, provided for carrying an electrostatic latent image, comprises a back electrode 21, a pyroelectric layer 22 laid on the back electrode 21, a float electrode 26 placed on the pyroelectric layer 22, and a resistive layer 27 arranged under the back electrode 21. The float electrode 26 comprises matrix of insulating material and tiny stainless steel hemispheres having a diameter of 10 μm and dispersed in the matrix and insulated from one another. The resistive layer 27 functions as a heat-medium.

In this embodiment, the pyroelectric layer 22 was 25 μm thick and made of a copolymer of poly(vinylidene fluoride) with trifluoroethylene, which had pyroelectric coefficient of 8 $nC/cm^2K$. The back electrode 21 was an aluminum film having a thickness of 100 nm. The resistive layer 27, used as the heating layer, is made of carbon-containing polyaramid film having a thickness of 15 μm and surface resistance of 600 Ω.

A recording head 3 is located, opposing the ink-ejecting section 1 of the recording medium 2. In this embodiment, the head 3 is one for performing printing in density of 360 dpi, comprising 180 needle-shaped electrodes 31 and a feedback electrode 32. A smooth recording paper sheet (not shown) having a thickness of 60 μm was used as a recording member.

In operation, the recording head 3 supplied a constant current to the needle-shaped electrodes 31, at recording cycle of 0.5 msec and pulse width of 0.2 msec, whereby a current flowed through the resistive layer 27 into the back electrode 21, and flows from the back electrode 21 through the resistive layer 27 to the feedback electrode 32. The voltage applied on the float electrode 26, i.e., the surface layer of the recording medium 2, increased a potential peak of 500 V with respect to the back electrode 21.

The ink-ejecting section 1 was so positioned that the counter electrodes 15 were spaced by 300 μm from the tip of the recording head 3. Then, a pulse voltage of 300 V of the reverse polarity was superposed upon a DC bias voltage of 200 V which was of the same polarity. The resultant voltage was applied to the common electrode 14 in synchronization with the pulse-voltage applying signals supplied to the recording head 3. Ink droplets were ejected from the ink-ejecting slit 18 toward the surface of the recording medium, on which a latent image had been formed. Thus it was found that data was actually recorded on the recording member 4.

In this embodiment the recording medium is continuously moved after the ink droplets adhere thereto. The ink is transferred from the recording medium into a recording member (not shown) which comes into contact with the medium. The residual ink is removed from the recording medium 2 by means of a cleaner.

Embodiment 5

Figure 8:
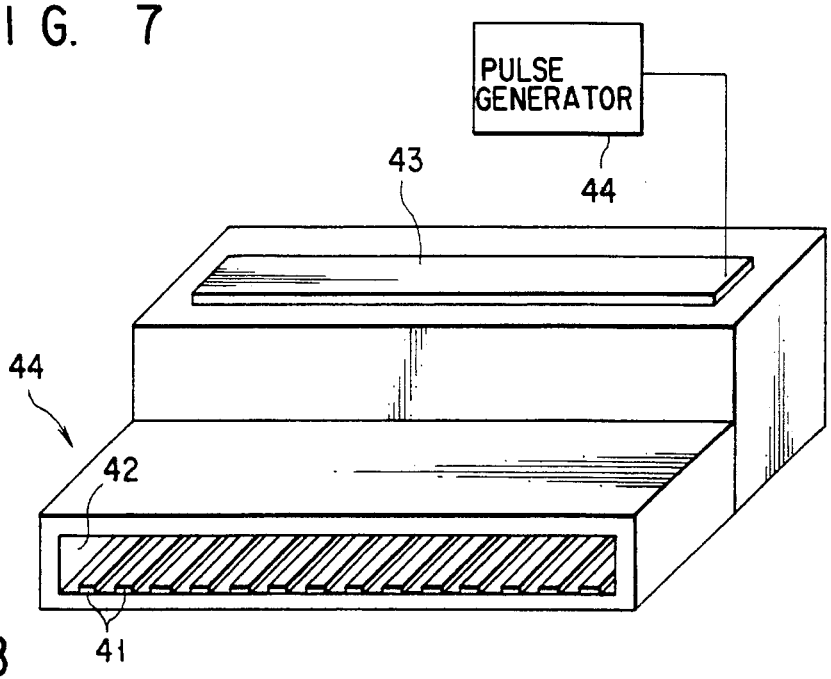
FIG. 8 is a perspective view illustrating the ink-ejecting section of an ink-jet recording apparatus according to the first aspect of the present invention.

FIG. 8 is a perspective view showing the ink-ejecting section of an ink-jet recording apparatus of this embodiment. This apparatus is designed to carry out serial-type ink-jet recording method.

As can be seen from FIG. 8, the ink-ejecting slit 42 of the ink-jet recording apparatus is similar to its counterpart of Embodiments 1 to 4. Counter electrodes 41 are arranged in the slit 42. This apparatus is characterized in that a piezoelectric element 43 is adhered to the top of the substrate which is a component of an ink-holding section 44. The piezoelectric element 43 is electrically connected to a pulse generator 45. When a pulse is supplied to it, the piezoelectric element 43 bends inwardly, deforming the substrate of the ink-holding section 44 inwardly. A pressure is thereby exerted on the ink contained in the section 44, forming an ink meniscus which has a surface convex toward outside from the ink-ejecting slit 42. The ink meniscus grows into an ink droplet, which is ejected forward from the slit 42. Other droplets are successively formed and ejected, one after another, as long as the voltage of the pulse remains high. When the pulse voltage falls to a reference value, the substrate of the ink-holding section 44 restores to its original shape, applying a negative pressure on the ink. The ink ejection is thereby forcibly terminated. Since vibration of presser is externally applied to the ink in the ink-holding section 44, the initiation and termination of the ink ejection can be accomplished with high controllability.

As shown in FIG. 8, only one piezoelectric element 43 is mounted on the top of the ink-holding section 44. It is more desirable that a plurality of smaller piezoelectric elements be adhered to the top of the section 44 and be simultaneously driven, in order to render enhance the response frequency of each element and to distribute a pressure wave more uniformly along the ink-ejecting slit 42.

Embodiment 6

Figure 9:
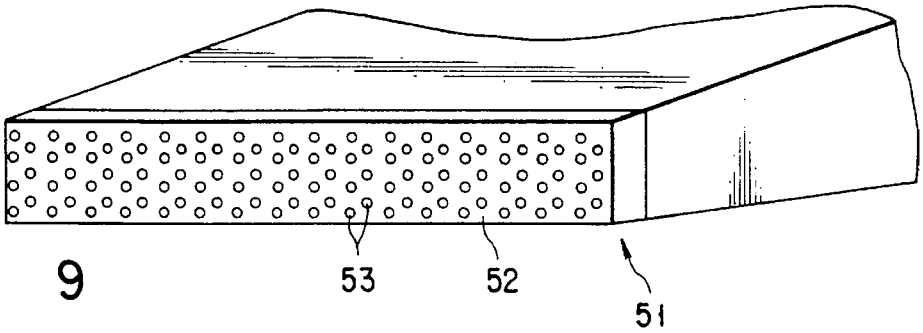
FIG. 9 is a perspective view showing the ink-ejecting section of another type of the ink-jet recording apparatus according to the first aspect of the invention.
Figure 10A:
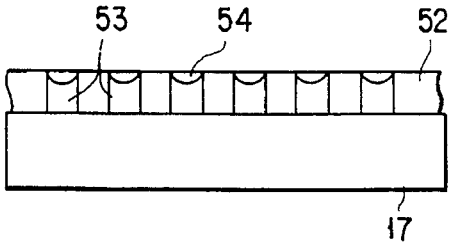
FIGS. 10A and 10B are sectional views of the ink-ejecting section illustrated in FIG. 9.
Figure 10B:
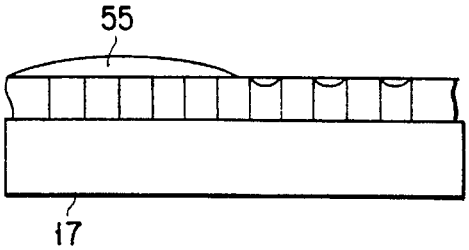
Figure 11:
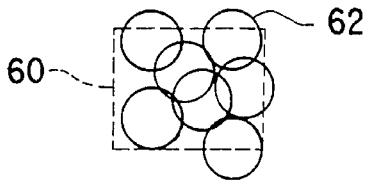
FIG. 11 shows a pixel printed by the apparatus shown in FIG. 9, which is formed of several ink dots.

FIG. 9 is a perspective view showing the ink-ejecting section of an ink-jet recording apparatus of this embodiment. The apparatus is characterized in that the ink-ejecting slit 51 is closed with a film 52 which has a number of holes 53. The pitch at which the holes 53 are arranged is less than the design resolution of the recording apparatus. The film 52 can easily formed by means of, for example, etching, electro forming, or the like. The film 52 is made of material which is hardly wetted, such as Teflon (trade name), or has the outer surface surface-treated to be water-repellent. Hence, as shown in FIG. 10A, menisci 54 are formed in the holes 53; ink is prevented from oozing through the holes 53 onto the outer surface of the film 52 to form a large meniscus 55 over several holes 53 as is illustrated in FIG. 10B. Thus, in every hole 53 of the film 53, the ink is attracted to the back electrode (not shown), due to the image-pattern potential thereof, and is thereby shaped into a droplet.

In this embodiment, since the holes 53 are small and arranged at a small pitch, several ink droplets 62 form one pixel 60. Even if an ink droplet fails to fly from one holes 53, for some cause, the ink droplets ejected from the adjacent holes 53 form a pixel 60. Thus, an entire pixel 60 scarcely fails to be formed. This improves the reliability of the ink-jet recording over the conventional ink-jet recording wherein one ink droplet forms one pixel.

In the conventional slit jet method, the direction and speed of each flying ink droplet are affected by the interference between the adjacent holes and the electric charge of the other ink droplets, inevitably deforming the recorded image. This undesirable phenomenon also occurs in this embodiment. However, the ink-jet recording apparatus well performs its function even if the behavior of individual ink droplets is disturbed, provided that ink droplets for forming a pixel are uniformly distributed on the image-pattern forming section of the back electrode. On this point, the recording scheme of this embodiment is similar to the development effected in electrophotographic recording. Therefore, the back electrode may be a photosensitive member, rather than a pyroelectric one. If so, the apparatus of this embodiment can be applied to an analog copier in which the light reflected from an original is applied directly onto the photosensitive body. Also in this case, the advantage of the present invention, i.e., non-use of a fixing device, can be preserved. The analog copy machine incorporating the ink-jet recording apparatus of this embodiment consumes less energy and can be made smaller, than the conventional analog copy machines.

In the present embodiment, the film 52 having holes 53 may be replaced by a porous block, which achieves the same advantage. The porous block can be made of sponge-like material such as foamed resin, sintered metal, or net-like material. The holes 53 are not necessarily be circular. They may be rectangular, polygonal, or of any other shape, so far as they are sufficiently small.

All embodiments described above are ink-jet recording apparatuses. Nevertheless, the principles of the first aspect of the present invention can be applied to electrophotographic recording apparatuses, a few embodiments of which will be described below.

Electrophotographic recording apparatuses perform non-impact recording, making little noise and printing clear-cut characters, achieving high-speed recording, and a relatively low running cost. For these advantages, they are recently employed as output terminals of office-automation apparatuses. Their market is fast broadening. In an electrophotographic recording apparatus, a toner image formed on the photosensitive body is transferred onto a paper sheet by applying an image-transfer electric charge to the paper sheet. The image-transfer ratio is 80 to 90% at best, and some toner would remain not transferred. Furthermore, the image-transfer ratio greatly varies, depending upon not only the ambient conditions such as temperature and humidity, but also the properties of the paper sheet such as thickness and material. The residual toner on the photosensitive body needs to be scraped off by a cleaner comprising a cleaning blade. The cleaning blade, made of elastic material such as rubber, comes into strong frictional contact with the surface of the photosensitive body, possibly damaging the surface of the photosensitive body and, thus, shortening the lifetime thereof. Another problem with the electrophotographic recording apparatus is the difficulty of using gain the toner collected by the cleaner. This is because the collected toner contains paper dust and the similar dust, and can hardly be used for a second time; it must be discarded. Hence, several tens of percent of all toner applied on the photosensitive body is wasted as useless. In addition, since the image-transfer ratio much changes, it is difficult for the apparatus to operate reliably in order to form high-quality images.

To minimize the amount of toner wasted, an electrophotographic recording apparatus having no clearer has been developed recently. In this apparatus, known as "cleaner-less type," the residual toner is removed by the developing device from the surface of the photosensitive body and is collected into the developing device. The toner collected is used again to record data on a paper sheet. Without a cleaner unit, this apparatus can be made smaller than one having a cleaner unit. Moreover, since toner is not wasted, thereby reducing the running cost. The cleaner-less type apparatus has a problem, however. In the image-transfer unit, toner moves very close to the paper sheet or contacts the paper sheet, and the dust or talc may enter the developing device, along with waste toner. The toner will then have its charging characteristic altered, which results in degradation of the images recorded.

The above-mentioned problems inherent in the electrophotographic recording apparatus will be solved by applying the principles of the first aspect of the invention. More specifically, the problems can be solved by a recording apparatus according to the first aspect of this invention, which comprises: a recording medium for carrying a latent image, a developing member opposing the recording medium, for holding developer and supplying the developer to a recording member, and developer-moving means for moving the developer from the developing member toward the recording medium. To state more precisely, toner (developer) supplied by a developing roller (developer-moving means) is attracted onto recording paper (recording member) by virtue of an external electrostatic field passing through the recording paper, forming a visible image identical to an electrostatic latent image. Hence, the toner need not be transferred from a photosensitive body onto the recording paper. It is unnecessary for the apparatus to have a transfer unit or a cleaner unit. The apparatus can therefore be small and serves to miniaturize electrophotographic printers.

The greatest advantage of the above electrophotographic recording apparatus resides in that there is no waste toner at all, without using spent toner. The running cost of the apparatus is therefore lower than that of the conventional electrophotographic recording apparatus which wastes the spent toner. Also, the apparatus has higher reliability than the conventional electrophotographic recording apparatus which use the spent toner again, since the residual toner usually contains paper dust and the like.

Specific embodiments of the electrophotographic recording apparatuses according to the first aspect of the present invention will now be described in detail.

Embodiment 7

Figure 12:
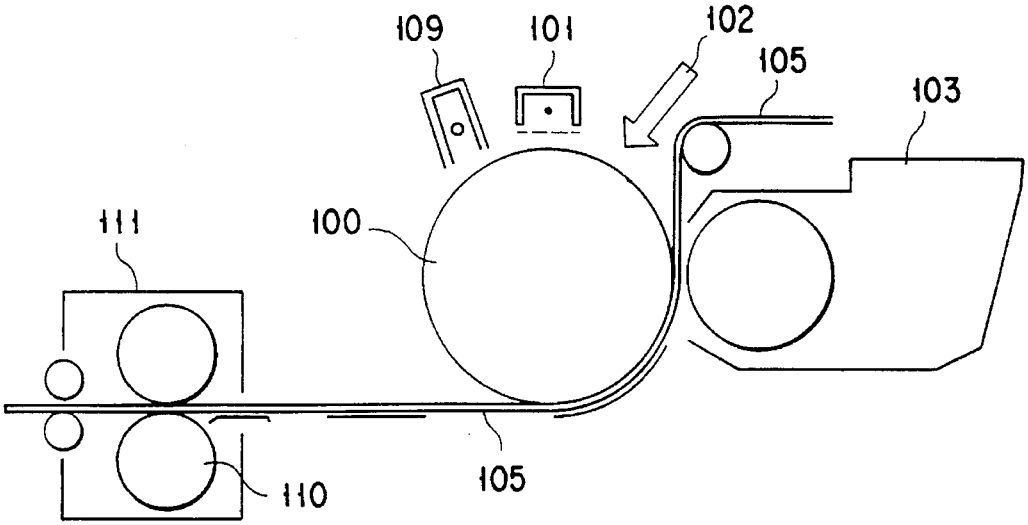
FIG. 12 is a schematic view illustrating an electrophotographic recording apparatus to which the first aspect of the invention is applied.

FIG. 12 schematically shows an electrophotographic recording apparatus of this embodiment. In operation, a photosensitive drum 100 is electrically charged by a corona charger 101. More precisely, the entire surface of the drum 100 is uniformly charged to, for example, about −700 V. Then, a laser beam 102 is applied onto the photosensitive drum 100 in accordance with image signals. The resistance of any portion of the drum 100 that is irradiated with the beam 102 decreases, whereby negative charge is removed from that portion of the drum 100. As a result, an electrostatic latent image is formed on the surface of the photosensitive drum 100. Paper-feeding rollers (not shown) are rotated, feeding a recording paper sheet 105 from a paper cassette (not shown) to a position near the photosensitive drum 100.

The electrophotographic recording apparatus according to this embodiment is characterized in that the recording paper sheet 105 is directly wrapped around the photosensitive drum 100. While the sheet 105 remains wrapped around the drum 100, a developing device 103 is moved close to the sheet 105 or into contact therewith. By virtue of the electric field generated by the latent-image potential of the drum 100, toner moves from the developing device 103 to the paper sheet 105, forming a toner image directly on the paper sheet 105. More specifically, a development bias is applied to the toner, i.e., colored particles negatively charged by reverse development, are attracted onto those portions of the electrostatic latent image on the drum 100, from which negative charge has been removed. As a result of this, the electrostatic latent image is rendered visible.

A fixing device 111 having a pair of rollers 110 applies heat to the paper sheet 105 with the toner image formed on it. The toner image is thereby fixed on the paper sheet 105, completing the electrophotographic recording. One or both of the rollers 110 of the fixing device 111 are heating rollers. In the case, one roller 110 is a heating roller, it is desirable that the heating roller be the lower one, so that the toner image formed on the paper sheet 105 may be efficiently fixed. This is because the toner image has been formed on the lower side of the sheet 105. The photosensitive drum 100 is exposed at entire surface to the light emitted from a charge-removing lamp 109 which comprises an LED array or the like. The surface of the drum 100 is electrically discharged, and the drum 100 can be used in the next data-recording process.

This electrophotographic recording apparatus requires neither a transfer unit nor a cleaner unit, and can be made smaller and operate more reliably than otherwise. Further, since almost all toner on the paper sheet 105 can be used, the recording apparatus can operate at a low running cost.

In this embodiment, the electrostatic latent image can be developed into a toner image in various methods. The developing methods will be explained below.

Development methods are classified into two types, i.e., contact development and non-contact development. The non-contact development is more suitable for use in the electrophotographic recording apparatus according to this embodiment of the invention. To be more specific, toner particles are made to fly onto a paper sheet to develop an image on the paper sheet.

Figure 13:
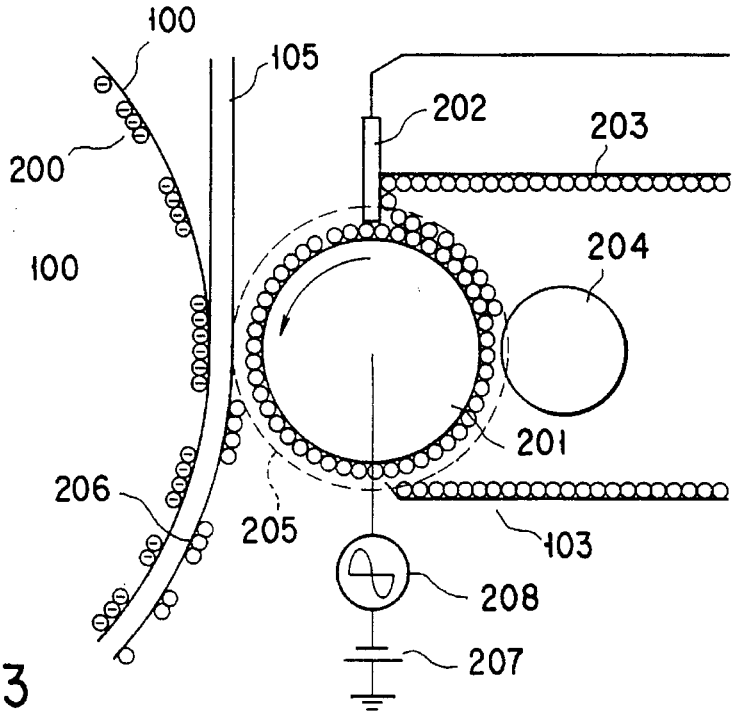
FIG. 13 is a diagrammatic view explaining how toner is applied onto recording paper from the developing device incorporated in the apparatus shown in FIG. 12.

FIG. 13 shows a developing device 103 which carries out non-contact development, using one-component nonmagnetic toner. The surface of a photosensitive drum 100 is charged negatively and uniformly. Then, light is applied to some portions of the drum surface. The portions of the drum surface, which have just been exposed to light, are thereby set at a potential higher than the other portions not exposed. As a result, an electrostatic latent image 200 is formed on the surface of the photosensitive drum 100. A recording paper sheet 105 is brought into contact with the surface of the photosensitive drum 100.

The developing device 103 comprises a developing roller 201, an elastic blade 202, a toner receptacle 203, and a toner-supplying roller 204. The developing roller 201 is rotated in the direction of the arrow shown in FIG. 13. The blade 202 is provided near the position where the paper sheet 105 comes into contact with the surface of the photosensitive drum 100. More specifically, the blade 202 functions such that the toner layer has a thickness almost equal to the diameter of toner particles, when it reaches the nip between the paper sheet 105 and the photosensitive drum 202, as the drum 202 is rotated in the direction of the arrow in FIG. 13. It controls the thickness of a toner layer provided on the developing roller 201. Two guide rings 205 are attached to the developing roller 201, each at one end thereof. The guide rings 205 have a diameter larger than that of the developing roller 201. In operation, the guide rings are pushed onto the recording paper sheet 105, thus spacing the developing roller 201 from the paper sheet 105 by a predetermined distance.

A DC bias 207 and an AC bias 208 are applied, as developing biases, to the developing roller 201. The DC bias 207, which is about 500 to 1000 V, is the main developing bias. Since the toner is negatively charged in most cases, the DC bias 207 applied on the developing roller 201 is a negative voltage. The toner particles are attracted onto those portions of the drum 100 from which negative charge has been removed and which defines the electrostatic latent image 200. Reverse development is thereby accomplished, forming a toner image 206 on the paper sheet 105. The DC bias 207 only can achieve development in this way. Nonetheless, the AC bias 208 of about 0.5 to 2 kVpp is also applied to the developing roller 201. The AC bias 208, thus applied, keeps vibrating the toner particles, moving them back and forth between the photosensitive drum 100 and the developing roller 201. Thus, the AC bias 208 helps to form toner images having a uniform density.

Generally, when a contact type developing device which effects contact development is employed, a mechanical force unnecessarily pushes toner particles into the inter-fiber gaps of recording paper, causing background staining on the paper sheet. However, the contact type developing device, as well as a non-contact type developing device, can be used to form a toner image on a paper sheet treated to have a smooth surface or on a resin sheet. To form an toner image on an ordinary paper sheet having a rough surface, contact development of general type cannot be performed. Instead, contact development should better be conducted, wherein the paper sheet is not forced to the developing roller strongly. In such development, a two-component developer is used, forming a magnetic brush which applies toner particles onto a recording paper sheet. The two-component toner comprises carrier (e.g., iron powder) and toner. The toner and carrier particles are electrically charged due to the friction among them, and some toner particles are electrostatically attracted to a carrier particle. When the two-component developer is applied onto a developing roller, both components are charged electrically by friction. The carrier particles stand upright thereon, forming a magnetic brush. The magnetic brush makes a soft contact with a paper sheet. Then, by virtue of the electrostatic force emanating from the latent image formed on the paper sheet, the toner particles move from the carrier particles onto the paper sheet, forming a toner image thereon. The force the magnetic brush exerts on the sheet is so small that no background staining occurs on ordinary paper sheets. Furthermore, since the toner particles attached to the magnetic brush can be located very close to the paper sheet, the potential of the latent image can be lower than in the case of non-contact development.

Embodiment 8

Figure 14:
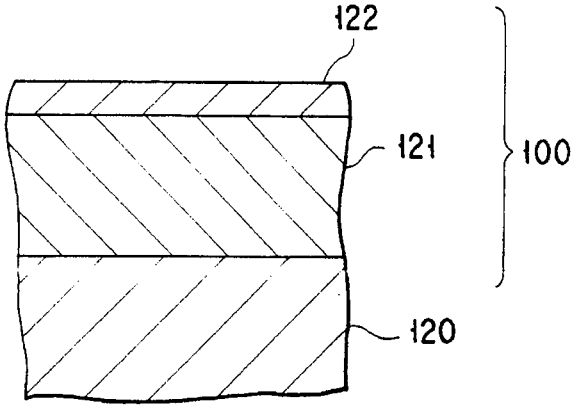
FIG. 14 is a sectional view depicting the structure of the photosensitive drum used in another type of the electrophotographic recording apparatus to which the first aspect of this invention is applied.

FIG. 14 illustrates the structure of the photosensitive drum 100 which plays an important role in the electrophotographic recording apparatus according to the first aspect of this invention. In the recording apparatus, a paper sheet 105 is directly placed upon the photosensitive drum 100, and a toner image is formed directly on the paper sheet 105. Unless the electric field emanating from the electrostatic latent image fully permeates to the outer side of the recording paper sheet 105, a toner image cannot be developed. The paper should therefore be located as close as possible to the electrostatic latent image. Since it is difficult to hold the recording paper at the same distance from the photosensitive drum, it would be appropriate to push the paper onto the photosensitive drum. In this case, it does not matter if the recording member is directly laid on the photosensitive drum, when the recording member is an insulator such as electrostatic recording paper or resin film. Thus, an electrophotographic printer can work even if incorporating an ordinary photosensitive drum as illustrated in FIG. 12.

When ordinary paper is used, however, a problem will arise if the paper is directly placed on the photosensitive drum. Although ordinary paper has high electric resistance, its electric conductivity is several orders of magnitude higher than that an insulator. Thus, an electric current may flow in the ordinary paper. It follows that, when an ordinary paper sheet is placed directly on a photoelectric drum on which an electrostatic latent image has been formed, an electric current flows through the paper sheet, inevitably disturbing the latent image. Moreover, the resistivity of paper largely depends on temperature and humidity. When the humidity changes several tens of percent, the resistivity will vary several orders as much.

To void this problem, use is made of a photosensitive drum which comprises a photosensitive layer and an insulating layer laid on the photosensitive layer. More specifically, a photosensitive drum 100 is employed which comprises, as shown in FIG. 14, a conductive metal drum 120, a photosensitive layer 121 laid formed the drum 120, and an insulating layer 122 formed on the photosensitive layer 121. The photosensitive layer 121 may be made of any ordinary photosensitive material such as Se-based on, A-Si, OPC, or the like. Needless to say, the layer 121 may have a multilayer structure having, for example, a carrier-generating layer and a carrier-transporting layer. The layer 121 can have whatever internal structure, but the outermost layer to contact recording paper must be the insulating layer 122.

Embodiment 9

Figure 15:
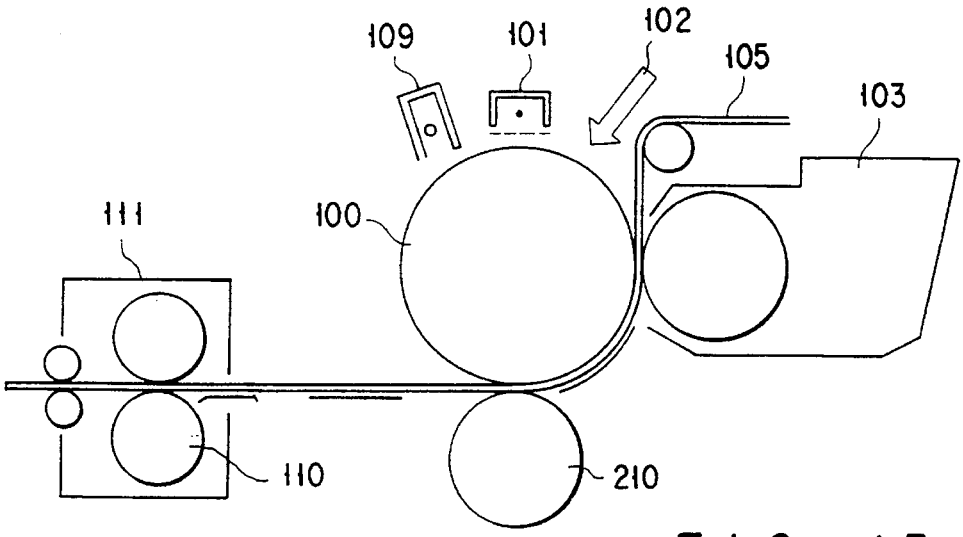
FIGS. 15, 16, 17A, 17B, 18, 19A and 19B are diagrammatic views showing still another type of an electrophotographic recording apparatus to which the first aspect of this invention is applied.

FIG. 15 diagrammatically shows another type of an electrophotographic printer of this embodiment. The printer has a specially designed means for fixing toner on recording paper. A toner image formed on a recording paper sheet is fixed, whereupon the recording is completed. The printer therefore must have a fixing device which is located, as shown in FIG. 12, in the vicinity of the outlet port for paper sheets.

A paper sheet 105 once contacts a photosensitive drum 100, but leaves the drum 100 after a toner image is formed on it. Toner adheres onto the paper sheet 105 due to the electrostatic force exerted from an latent image. Once the paper sheet 105 has been peeled from the photosensitive drum 100, the electrostatic force no longer acts on the sheet 105. In effect, the toner remains adhering to the paper sheet even after the sheet has been peeled from the drum, by virtue of a van der Waals force, a force induced from polarization, or a mechanical force resulting from friction between the drum and the sheet. Nevertheless, the toner image may be deformed when a huge mechanical vibration takes place.

In order to solve this problem, in the apparatus of FIG. 15, a temporary fixing roller 210 temporarily fixes the toner on the recording paper sheet 105 before the sheet 105 is peeled off the photosensitive drum 100. The temporary fixing roller 210 is pushed onto the paper sheet, a pressure is exerted on the toner which are attracted onto the sheet 105 under an unstable electric force. Thus, the toner particles are forced into the surface of the recording paper sheet and would not fall off from the sheet even if some impact were applied to the sheet. When the paper sheet 105 is peeled from the photosensitive drum 100, with the toner temporarily fixed, neither the toner will fall off, nor the toner image will be deformed, before the recording paper sheet reaches a fixing device 111.

The temporary fixing roller may be a rigid one designed as a pressure fixing or thermal fixing. The temporary fixing roller 210 can be of a simple structure since the fixing device 111 permanently fixes the toner on the paper sheet. Successful temporary fixing can be achieved even if the temporary fixing roller is an elastic and soft pressure fixing roller. If a heating fixing roller is used for the temporary fixing roller, it need not be heated to a relatively high temperature, so far as it serves to fix the toner temporarily. A voltage of the same polarity as that of the toner may be applied to the temporary fixing roller 210 to prevent the toner from adhering onto the roller 210, thereby achieving neat permanent fixing of the toner.

Figure 16:
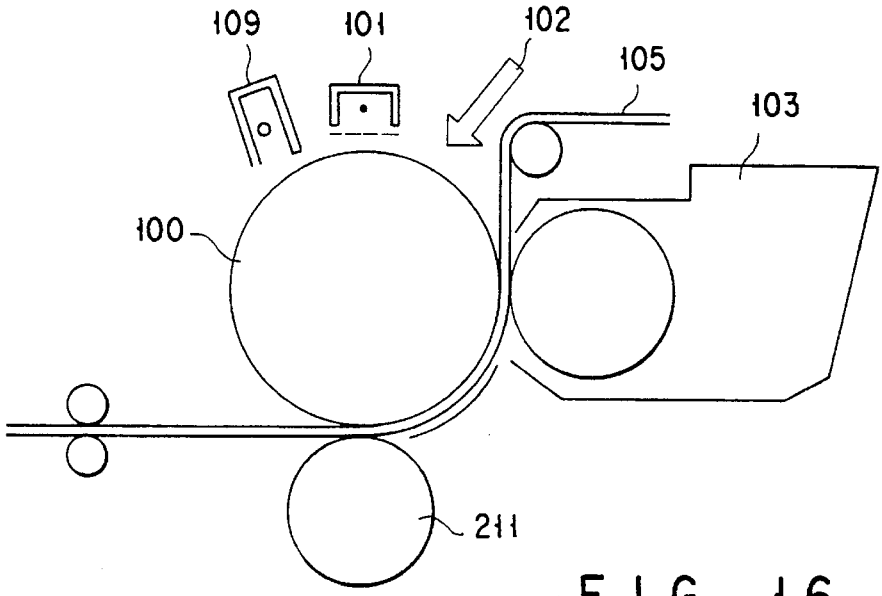

FIG. 16 schematically shows still another type of an electrophotographic printer of this embodiment. In this printer, the fixing roller 211 fixes toner completely before a recording paper sheet 105 is peeled from the photosensitive drum 100. This makes it possible to make the recording apparatus smaller. Also in this case, the fixing roller 211 may either be a heating roller or a pressure fixing roller. A sufficient fixing strength is required unlike in the above-mentioned temporary fixing. Thus, the fixing roller 211 must be heated to at least 100° or more if it is a heating roller, and must be adequately rigid if it is a pressure fixing roller.

Embodiment 10

Electrophotographic recording apparatuses are roughly classified in some types. The above embodiments are laser printers. Printers of the type wherein a light beam is applied to form an electrostatic latent image are classified as optical printers. Most of the electrophotographic printers are optical printers, which includes, besides laser printers, those having an LED head, those provided with an EL (Electroluminescent) head, those incorporating a fluorescent head, and those equipped with a liquid crystal head.

Electrophotographic recording apparatuses of another type are available. These apparatuses carry out electrophotographic recording method in which ions are applied directly onto an insulator, to thereby record an electrostatic latent image thereon. This recording method is called "ion flow recording" or "ion deposition recording." This embodiment is designed to perform ion deposition recording.

Figure 17A:
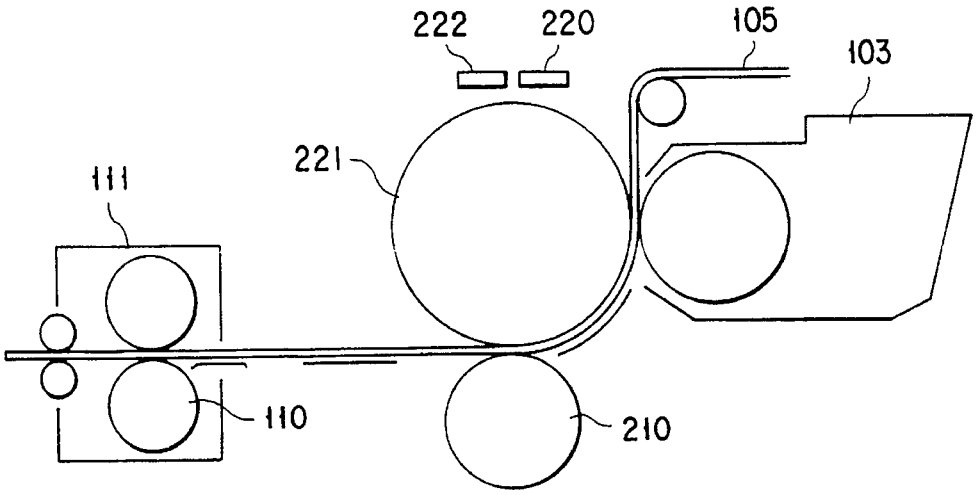
Figure 17B:
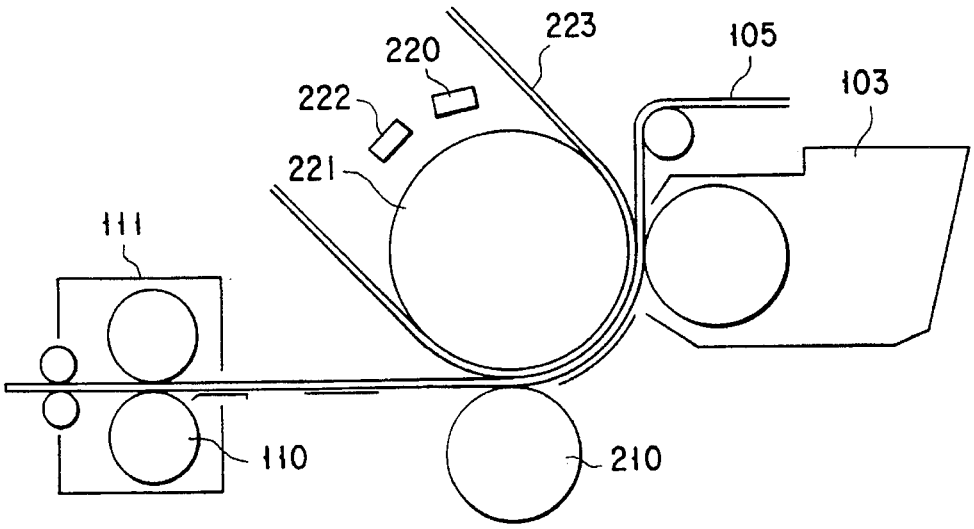

FIGS. 17A and 17B are diagrams for explaining the outline of an electrophotographic printer according to the present embodiment. This printer is similar in basic structure to the printer shown in FIG. 15. Nonetheless, its structure may be based on the apparatus shown in FIG. 12 or FIG. 16. This embodiment is characterized by the use of an ion head 220, whereas, in the above-described embodiments, light is applied to a portion to form an electrostatic latent image thereon.

In ion deposition recording, a recording drum 221 of insulation is used. The recording drum 221 is uniformly charged by means of a charger 222. The charger 222 may be such a corona charger as is shown in FIG. 12. In this embodiment, the charger 222 is a solid-state ion generator. The ion head 220 incorporates an ion generator which has a structure similar to that of the charger 222. The ions generated by the ion generator are controlled by control electrodes in accordance with image signals, thereby recording an electrostatic latent image on the recording drum 221. Ion deposition recording is described in detail in, for example, Jpn. Pat. Appln. KOKAI Publication No. 04-211971.

After the electrostatic latent image has been thus formed on the recording drum, a recording paper sheet 105 is placed on the drum 221 in the contact state. Thereafter, a toner image is formed directly on the paper sheet 105 in the same way as has been described above.

The electrophotographic printer much differs from the above-described optical printers in that use is made of an insulating recording drum 221. Hence, the printer shown in FIG. 17A well operates if the paper sheet 105 is an insulator. However, if the paper sheet is an ordinary paper sheet which is electrically conductive, it will deform the electrostatic latent image formed on the recording drum 221. In the case of an optical printer, this problem is solved by using the photosensitive body of FIG. 14 having an insulating layer which is located between a recording paper sheet and the photosensitive layer of the photosensitive body. In the ion deposition recording, however, it is required that the drum 221 be insulated from the paper sheet 105 after forming an electrostatic latent image on the insulating recording drum 221 by ions.

To fulfill this requirement, the printer may be modified as illustrated in FIG. 17B. To be specific, an insulating film 223 is wrapped around the recording drum 221 which has been uniformly charged by the charger 222 and on which an electrostatic latent image has been formed by the ion head 220, then a recording paper sheet 105 is placed on the insulating film 223, and development is carried out. The ion deposition recording is thus accomplished, forming a toner image directly on the ordinary paper sheet, without deforming the electrostatic latent image. Although not shown in FIG. 17B, the insulating film 223 is shaped like an endless belt. It is desirable that the insulating film 223 be so structured that it can be used again once it has been electrically discharged by means of the charger or the like. If not endless, the insulating film 223 may be wound around a feeding reel and a take-up reel, so that it may reciprocate between the reels and may thus be used repeatedly. The insulating film is not limited to a particular one. It may be PET film which can be available at low cost.

Embodiment 11

In the embodiments described thus far, an electrostatic latent image is recorded by using nonmagnetic toner. Other embodiments can be devised, in which magnetic toner is applied. In the case where magnetic toner is used, a magnetic latent image is formed, instead of an electrostatic one, and is eventually developed with magnetic toner. A magnetic latent image is preferable since it is extremely stable to changes in the ambient temperature. An electrostatic latent image suffers the prominent potential change due to changes in humidity, but a magnetic latent image is stable. However, since the magnetic particles contained in magnetic toner are black in most cases. Consequently, even if magnetic toners of different colors are applied to achieve color recording, a beautiful full-color image cannot be obtained. Nevertheless, magnetic toners well serve the purpose of accomplishing black-and-white recording, multi-color recording, or full-color recording in which plurality of drams are provided in parallel.

Figure 18:
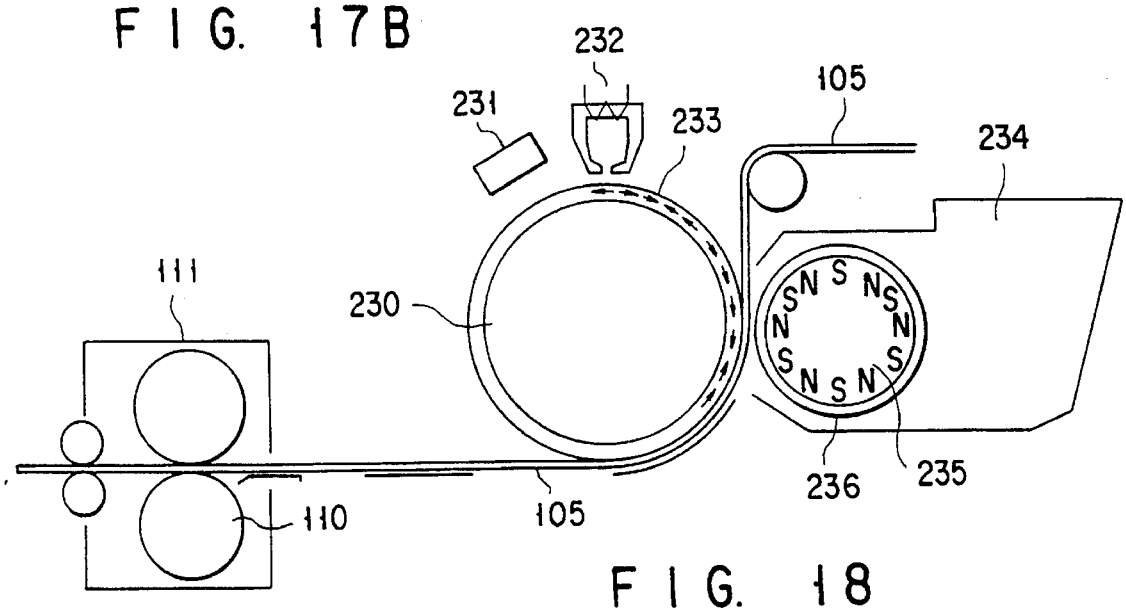

FIG. 18 illustrates another electrophotographic recording apparatus according to this embodiment, which uses magnetic toner. The specific permeability of paper or resin is approximately 1. Therefore, any magnetic latent image formed of the magnetic toner is hardly affected by the material of the recording member, whether paper or resin, even when the recording member is located between a recording drum and a developing device. This is a desirable feature of a magnetic latent image. By contract, an electrostatic image transferred onto a paper or resin sheet is somewhat blurred since paper and resin have a dielectric constant of about 2 to 3, depending on the type of the paper or resin used. Thus, the use of an magnetic latent image results in stable forming of an image, not adversely influenced by the ambient conditions or the material of the recording paper.

In the present embodiment, a magnetic drum 230 is employed. As shown in FIG. 18, the drum 230 has a layer of magnetic material coated on its surface.

First, the magnetic drum 230 is electrically discharged by means of an erasing head 231, whereby the previously recorded magnetic latent image is erased from the magnetic drum 230. The erasing head 231 is either one which operates like a magnetic head, electrically controlling the generating of a magnetic field, or one which ceaselessly generates a magnetic field as a permanent magnet. The magnetic field generated by the erasing head 231 forms, on the magnetic drum 230, a residual magnetization pattern of the same direction, thereby erasing the previously recorded magnetic latent image.

Then, a magnetic latent image is formed on the magnetic drum 230 in accordance with image data. The magnetic recording head 232 shown in FIG. 18 is designed to perform in-plane recording. The head 232 comprises a number of head units juxtaposed along a line perpendicular to the plane of the drawing. When driven, the head 232 generates a residual magnetization pattern indicated by short arrows in FIG. 18, thereby forming a magnetic latent image 233. The magnetic latent image 233 reverses the magnetization pattern at those portions of the drum 230 where pixels are to be formed, while maintaining the same magnetization pattern at the other portions of the drum 230 where no pixels are to be formed. The magnetic drum 230 is rotated and moves the recording paper sheet 105 held on it to a developing device 234. The developing device 234 comprises a magnet roller 235 having N poles and S poles alternately arranged in the surface, and a sleeve 236 made of nonmagnetic material and surrounding the magnet roller 235.

Magnetic toner is attracted onto the sleeve 236 by virtue of the magnetic force the roller 235 generates. As the magnet roller 235 is rotated, the toner on the sleeve 236 is transported and comes into contact with the paper sheet 105 mounted on the magnetic drum 230. The magnetic field emanating from the magnetic latent image formed on the drum 230 permeates the paper sheet 105. As a result, the magnetic toner is attracted onto the recording paper sheet 105, forming a toner image on the paper sheet 105.

The toner image, thus formed, is fixed on the paper sheet 105 in the same way as has been described above.

In the present embodiment the magnet roller 235 is rotated to transported. Instead, the sleeve 236 may be rotated, while the roller 235 is held steadfast, to thereby attain the same result. A magnetic force is used, attracting the magnetic toner onto the sleeve 236. Instead, an electrostatic force may be applied for the same purpose. This embodiment is an electrophotographic recording apparatus which forms a magnetic latent image in a plane. Nonetheless, it can accomplish vertical recording as well.

Embodiment 12

This embodiment is an electrophotographic recording apparatus which develops an electrostatic latent image into a toner image. The apparatus is characterized in the method it employs to form an electrostatic latent image. This electrophotographic recording apparatus will be described, with reference to FIGS. 19A and 19B.

Figure 19A:
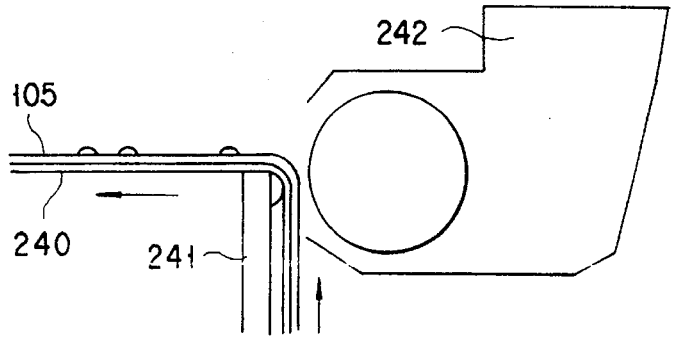
Figure 19B:
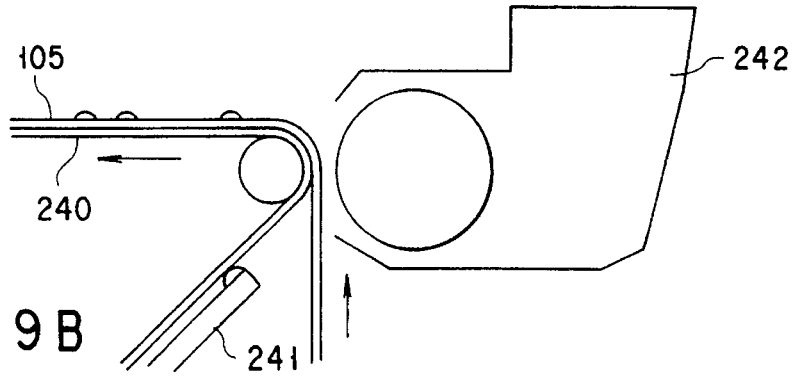

As shown in FIGS. 19A and 19B, a pyroelectric belt 240 is set in press contact with a thermal head 241, and a recording paper sheet 105 is placed in press contact with the pyroelectric belt 240. When heated, the pyroelectric belt 240 is internal polarized and generates a voltage. Hence, when the thermal head 241 heats selected portions of the belt 240 in accordance with image data, an electrostatic latent image is formed on the pyroelectric belt 240. The electric field emanating from the electrostatic latent image attracts onto the paper sheet 105 from the roller of a developing device 242. A toner image is thereby formed directly on the paper sheet 105. The sheet 105 with the toner image formed on it is fixed, thus completing the electrophotographic recording.

The pyroelectric belt 240 is either an endless belt or a length of a belt, which can be used repeatedly. It is subjected to natural cooling or forced cooling to be electrically discharged, and is then used again. In the embodiment shown in FIG. 19A, the thermal head 241 applies heat onto the reverse side of the pyroelectric belt 240. By contrast, in the embodiment of FIG. 19B, the thermal head 241 applies heat onto the obverse side of the pyroelectric belt 240. Although it takes much time to develop a latent image into a toner image, the blurring of the latent image due to the heat diffusion can be compensated for since the latent image is formed on the obverse side of the pyroelectric belt 240.

As may be understood from the above, the first aspect of the present invention can be applied to an electrophotographic recording apparatus wherein a pyroelectric member is heated to form an electrostatic latent image. This embodiment incorporates a thermal head for heating the pyroelectric belt. Instead, an optical head may be employed. For example, the surface of a pyroelectric member may be scanned with a laser beam, thus heating selected portions of the member to form an electrostatic latent image on the pyroelectric member. If an optical head is used to record data, it is most desirable that a light-absorbing layer be located at that side of the pyroelectric member which faces away from the recording paper sheet, for the purpose of increasing the efficiency of converting light into heat. In the apparatus of FIGS. 19A and 19B, a belt-shaped medium is used as the medium on which to form a latent image. Nevertheless, the belt-shaped medium may be replaced by a drum-shaped one as Embodiments 7 to 11, provided that the pyroelectric member will have been sufficiently cooled when the it is used again. Conversely, a belt-shaped medium, such as a photosensitive belt, an insulating belt or a magnetic belt, can be used in Examples 7 to 11.

The second aspect of the present invention will now be described. A recording apparatus according to the second aspect of the invention comprises: an ink-holding section having a common opening section, for holding at least one type of ink and ejecting ink; a plurality of pixel electrodes located in the ink-holding section and juxtaposed along the common opening; at least one common electrode opposing the common opening, for imparting potential differences to the pixel electrodes; and means for controlling the potential of each of the pixel electrodes to shift an ink-ejection position along the common opening or to change an ink-ejection direction with respect to the common opening. In this recording apparatus, a recording member is held on the common electrode and located between the common electrode and the common opening.

More preferably, the recording apparatus may further comprise a plurality of auxiliary electrodes located between the common opening and the common electrode. At least one auxiliary electrode is associated with each pixel electrode, for applying a potential difference to the pixel electrode, individually.

In the case where auxiliary electrodes are used, the means for controlling the potential of each of the pixel electrodes to shift an ink-ejection position along the common opening or to change an ink-ejection direction with respect to the common opening, can be dispensed with.

Due to the use of the means for controlling the potential of each of the pixel electrodes, to shift an ink-ejection position along the common opening or to change an ink-ejection direction with respect to the common opening section, vector scanning, not the conventional raster scanning, can be employed to scan pixels in analog fashion. Hence, the apparatus can reproduce a curved-line image faithful to the original, without the necessity of enhancing the density of pixels. In other words, the apparatus prints a curved line (i.e., a series of dots with vector), not a series of discrete dots. Thus, the recording apparatus according to the second aspect of the invention can print smooth curved lines.

The principles and operation of the apparatus according to the second aspect of the invention, which can effect vector scanning, will be explained. In slit jet recording, the position where recording is effected by an electrode shifts toward the immediately adjacent electrode due to the interference between the magnetic fields generated by the electrodes (The transactions of the Institute of electronics, Information and Communication Engineers Society, Vol. J66-C, No. 1, January 1983). This specific phenomenon is the basis of the second aspect of the present invention. Positive use of this phenomenon, which is detrimental to the slit jet recording, is the essence of the second aspect of the present invention.

A more advanced recording apparatus according to the second aspect of the present invention is provided as follows. This apparatus has an array of auxiliary electrodes which are located between a common opening section and a common electrode, for applying potential differences to pixel electrodes individually. The response frequency of each pixel electrode is thereby enhanced greatly. Each pixel electrode is connected to a voltage source of hundreds of volts. A relatively high current is to be applied to the pixel electrodes, and the pulse generator having a high withstand voltage and used as the voltage source must satisfy strict output-current requirements. The use of the auxiliary electrodes makes it possible to greatly reduce the output current of the pulse generator having a high widthstand voltage, and also to replace a high withstand voltage pulse generator with a micro booster array wherein a thermal head driver IC drives and heats the insulator formed on the pyroelectric film, thereby generating a high voltage. Unlike photosensitive material, pyroelectric material need not be shielded from light. Thus it is a preferable material provided that it has a sufficient charge capacity. The greatest advantage resulting from the use of auxiliary electrodes resides in that both pyroelectric material and a driver IC for TPH can be utilized.

In the case where the auxiliary electrodes are used, the excelled ink-jet recording apparatus is realized without means for controlling the potential of each of the pixel electrodes to shift an ink-ejection position along the common opening or to change an ink-ejection direction with respect to the common opening section.

The ink-jet recording apparatus according to the second aspect of the present invention has an ink-ejecting section of slit nozzle type. Hence, it hardly involves ink clogging which may occur when the ink dries and has high reliability. In addition, since the apparatus has no nozzles, each corresponding to one pixel, it can perform vector scanning, not the conventional raster scanning, to scan pixels in analog fashion. The apparatus can therefore reproduce a curved-line image faithful to the original, without the necessity of enhancing the density of pixels.

Not only a slit nozzle involves less frequently to involve ink clogging than an individual nozzle array, but also a slit nozzle is more easy to clean than an individual nozzle array. All more for it, the apparatus of the second aspect of the present invention is advantageous.

Two embodiments according to the second aspect of the present invention will now be described, with reference to FIGS. 20 to 23.

Figure 20:
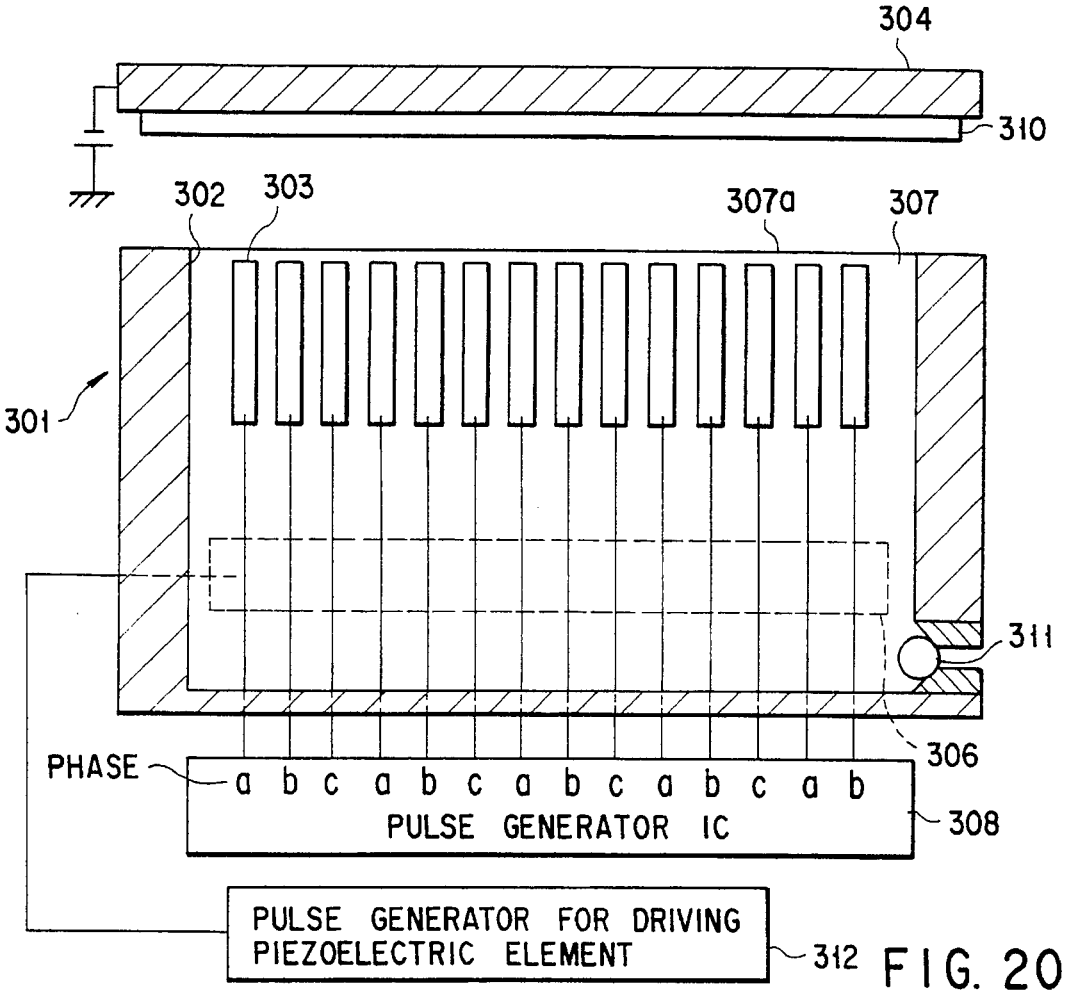
FIG. 20 is a schematic view representing an ink-jet recording apparatus according to a second aspect of the present invention.

FIG. 20 is a diagram schematically representing an ink-jet recording apparatus according to an embodiment of the second aspect of the present invention. The apparatus comprises an ink-holding section 301, a plurality of pixel electrodes 303, and a common electrode 304. The ink-holding section 301 has a common opening section 302 for holding ink 307 and ejecting the ink 307. The pixel electrodes 303 are mounted on an inner surface of the ink-holding section 301 and juxtaposed along the common opening section 302. The common electrode 304 opposes a common opening section 302, for applying negative potential to the pixel electrodes 303. A recording paper sheet 310, on which data will be record, is placed on that surface of the common electrode 303 which opposes the surface 307*a* of ink.

A piezoelectric element 306 is mounted on an inner surface of the ink-holding section 301. The element 306 is connected to a pulse generator 312. When the pulse generator 312 applies a pressure-generating signal voltage to the piezoelectric element 306, the side wall on which the element 306 is mounted bends inwardly. A meniscus is formed on the ink surface 307*a*. At the same time the ink meniscus is thus formed, an image signal voltage is applied on selected ones of the pixel electrodes 303, thus creating electrostatic attraction. As a result, ink droplets fly toward the common electrode 304 from only those portions of the ink surface 307*a* which are located at the selected pixel electrodes 303 by the electrostatic attraction. At the time the pulse generator 312 stops supplying the image signal voltage to the piezoelectric element 306, ink droplets are divided compulsorily. In a recording apparatus wherein ink needs to be ejected in the form of threads, it is possible, in principle, to control the ink ejection by applying only an electric field onto the ink, without using the piezoelectric element 306. However, the application of an electric field only can hardly achieve successful control of the ink ejection, as will be described later.

The ink-holding section 301 has a stop valve (or a micro valve) 311. Ink is supplied into the section 301 through the stop valve 311. A pulse generator IC 308 having a high withstand voltage is connected to the pixel electrodes 303 and used as a voltage source for applying a voltage on the pixel electrodes 303. The pulse generator IC 308 has been developed as a device for driving piezoelectric elements. Applicable as this pulse generator IC is, for example, a multi-channel, high-withstand voltage pulse generator disclosed in Proceedings of the Second NIP Technology Symposium, pp. 63–68.

Figure 21A:
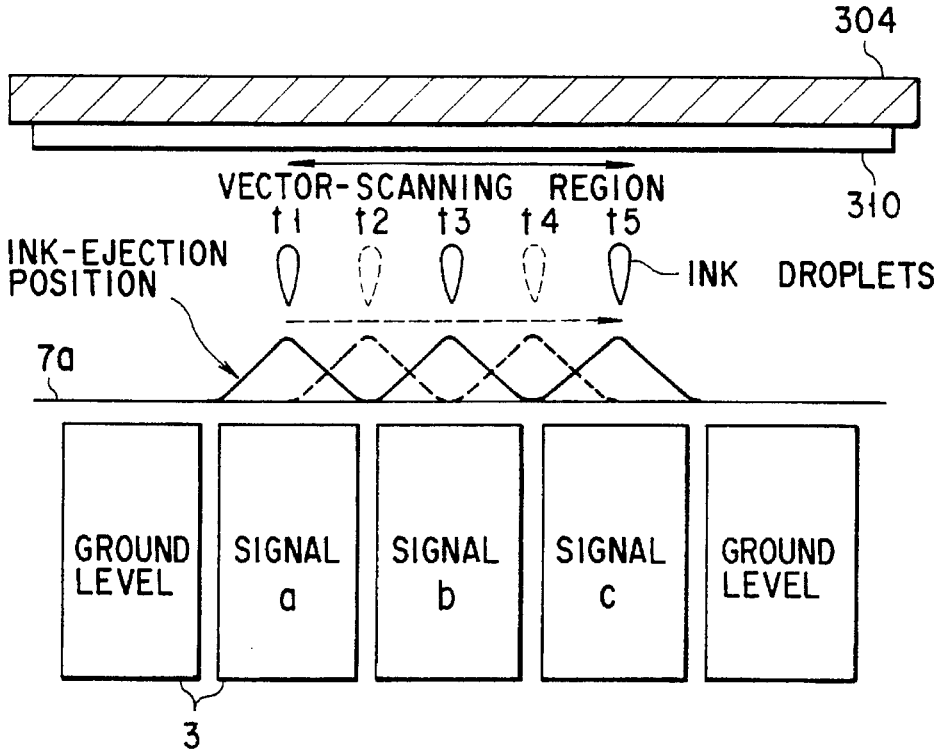
FIG. 21A is a diagram for explaining how the apparatus shown in FIG. 20 ejects ink droplets in a three-phase divisional drive mode.
Figure 21B:
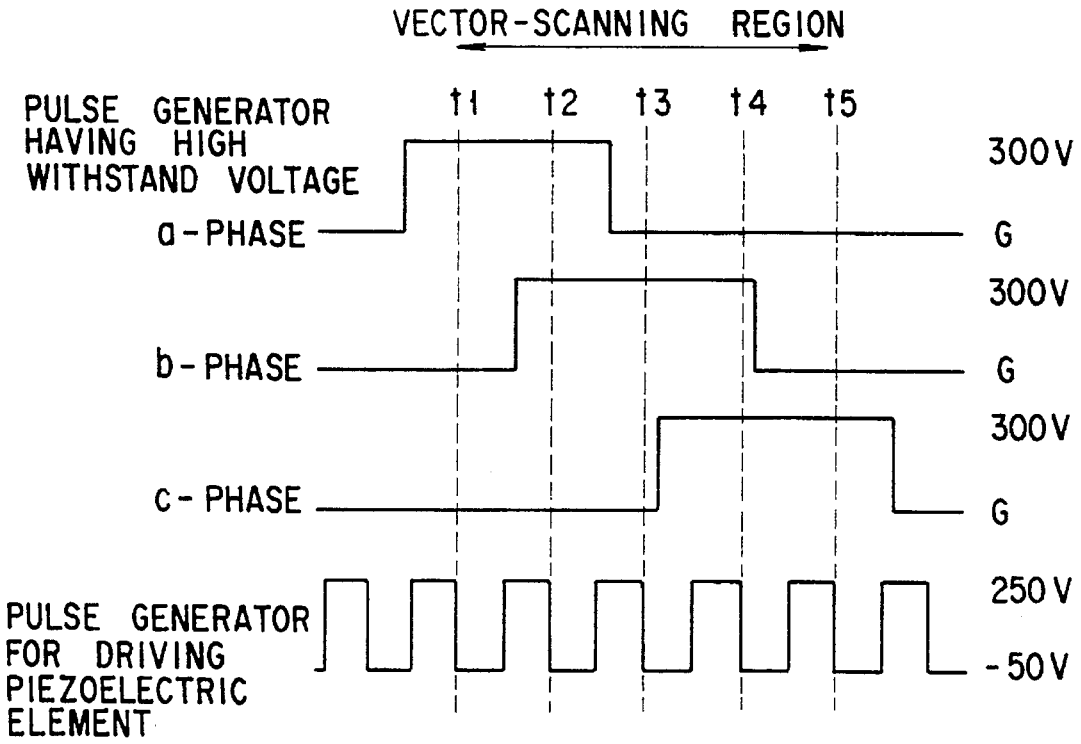
FIG. 21B is a timing chart showing the timing of generating high-voltage pulses when the apparatus of FIG. 20 operates in the three-phase divisional drive mode.

The pixel electrodes 303 are driven, group by group, in order to accomplish vector scanning. In this embodiment, the pixel electrodes 303 are driven in three-phase divisional mode, that is, in a-phase, b-phase, and c-phase, by drive signals supplied to them, so that three pixels are vector-scanned. FIG. 21A illustrates how the apparatus ejects ink droplets when the pixel electrodes are driven in the three-phase divisional mode. FIG. 21B is a timing chart explaining the timing of driving the pixel electrodes in a-phase, b-phase, and c-phase. In the three-phase divisional drive mode, the three phase shift in the scanning direction, while overlapping one another. In the portion where the phases a and b overlap, the ink-ejection position shifts in the scanning direction because the b-phase potential interferes with the electric field. An ink-ejection position is formed halfway between an a-phase pixel electrode and a b-phase pixel electrode, too. Similarly, an ink-ejection position is defined halfway between the b-phase pixel electrode and a c-phase pixel electrode. Thus, five ink droplets are formed for every three pixels.

The ink droplets are divided compulsorily at the time the pulse generator IC 308 stops supplying a pressure-generating signal voltage to the piezoelectric element 306.

In this embodiment, the frequency of the signal driving the piezoelectric element and the timing of supplying the same can be changed so as to scan the pixels in more analog like manner. However, it is considerably difficult for the pulse generator IC 308 to generate a voltage higher than a two or more. Usually the pulse generator IC 308 applies a voltage of one level to the pixel electrodes. The ink ejection is inevitably unstable, except at a position between two adjacent pixel electrodes.

The apparatus shown in FIG. 20 can thus record data by means of vector scanning. When a pixel is scanned to the right in FIG. 21A, whereas the pixel of the same phase located on the right side is vector-scanned in the opposite direction, four adjacent pixel electrodes will be set at the same voltage and will perform an erroneous ink ejection. To prevent such erroneous ink ejection, vector scanning along such a direction that adjacent pixels of the same phase combine together must be inhibited.

The recording apparatus of FIG. 20 is, disadvantageous in two respects. First, the scanning speed is low because each line must be scanned at the frequency of 300 to 400 Hz in order to drive the pixel electrodes in at least three phases (three-divisional mode). Secondly, the pulse generator IC having a high withstand voltage is expensive since it must have a considerably large current capacitance in order to supply recording signals to many pixel electrodes and must, therefore, be manufactured reliable bipolar process which involves separation of dielectric elements (see The Transactions of the Institute of Electronics, Information and Communication Engineer, SSD78-105, 1978). Hence, the apparatus of FIG. 20 needs to be improved.

Figure 22:
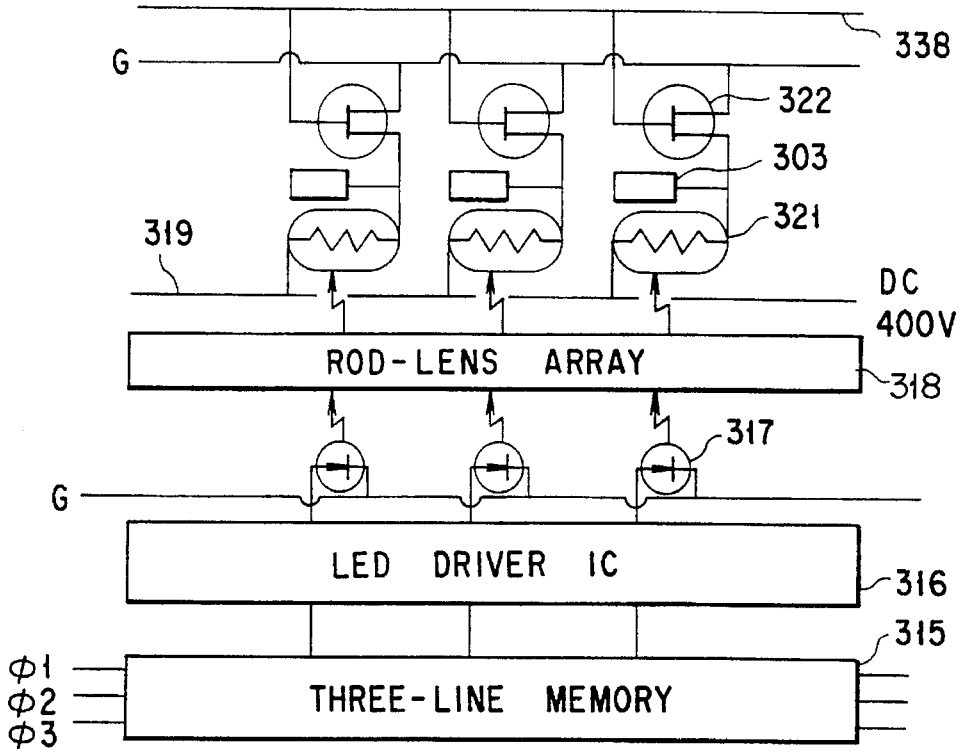
FIG. 22 is a block diagram showing another type of the ink-jet recording apparatus according to the second aspect of the present invention.

FIG. 22 is a block diagram showing another type of the ink-jet recording apparatus according to the second aspect of the present invention. This apparatus incorporates an array of photoconductive elements and light-emitting diodes (LEDs), which are used in place of the pulse generator IC for performing direct drive of pixel electrodes.

A voltage (or a current) is supplied to each pixel electrode 303 from a DC high-voltage line 319 set at 400 V, through an element 321 made of photoconductive material. The voltage of the pixel electrode 303 rises as electric charge accumulates in the electrode 303 since the current is continuously supplied to the electrode 303 via the photoconductive element 321. When the charge increases above a critical value, ink ejection starts under an electrostatic force. At this time the pixel electrode 303 is discharged to a normal voltage. The normal voltage primarily depends on the physical properties, size and shape of the elements 321 and the amount of light applied thereon. However, the normal voltage of each pixel electrode 303 can be adjusted by controlling the amount of light applied on the photoconductive elements 321. More specifically, an LED driver 316 changes the width and duty of LED-driving pulses at such a high speed that the photoconductive elements 321 cannot respond to changes in the amount of light applied on them.

A line memory 315 is connected to the LED driver 316, for storing control data and image signals. The control data includes data representing the ground potentials of adjacent pixels. The image signals read from the line memory 315 are supplied to the LED driver 316. In accordance with the image signals, the LED driver 316 generates drive signals, which are supplied to LEDs 317. Driven by the drive signals, the LEDs 317 emit light beams. The light beams are applied onto the photoconductive elements 321 through rod lenses which are juxtaposed, forming an array 318. The pixel electrodes 303 are coupled to the ground potential by thin-film transistors (TFTs) 322. When supplied with a rest pulse signal, the TFTs 322 are reset to the ground potential within a short time. The adjacent pixel electrodes are grounded so as to be driven in multi-phase drive mode. The ink-jet recording apparatus further comprises reset-pulse signal lines 338.

Figure 23:
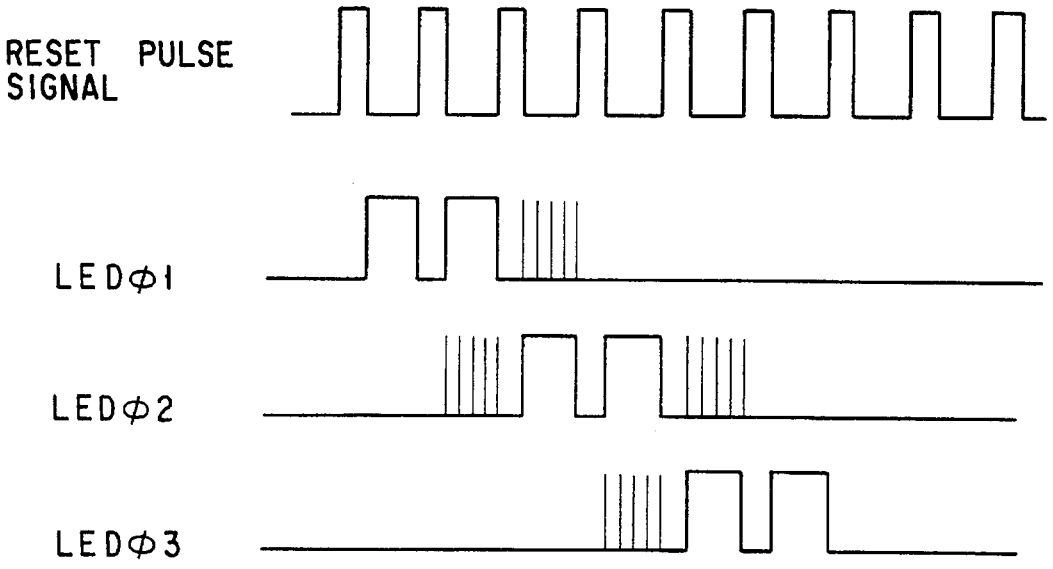
FIG. 23 is a timing chart explaining how the apparatus shown in FIG. 22 operates in three-phase divisional drive mode.

FIG. 23 is a timing chart explaining how the apparatus of FIG. 22 operates in three-phase divisional drive mode. The signals described vertical lines shown in FIG. 22 indicates that the LED driver 316 changes the width and duty of the LED-driving pulses at such so high speed that the photoconductive elements 321 cannot respond to changes in the amount of light applied.

The LED array may be replaced by an array of end-emission type EL elements, unless that the absorption wavelengths of the EL elements are problematical. The photoconductive elements 321 can be each an inorganic thin film or an organic thin film. Nevertheless, the inorganic thin film is preferred, particularly a thin film of hydrogenated amorphous silicon (a-Si:H). This is because the inorganic film exhibits higher quantum efficiency (=1), a larger secondary current value, a shorter recombination time of carrier and can be used as a thin-film semiconductor material which has higher carrier mobility and higher withstand voltage. Furthermore, high-withstand voltage switching elements may be used in place of the TFTs 322, unless their use increases the manufacturing cost of the apparatus, along with the use of the pulse generator IC.

In this embodiment, the LED driver 316 changes the width and duty of the LED-driving pulses, ultimately controlling the amount of the light applied on the photoconductive elements 321. Thus, the voltage of the pixel electrodes 303 can be changed, making it possible to scan the pixel electrodes 303 in a more analog like fashion than in the case the electrode 303 are directly driven by the pulse generator IC.

The embodiment shown in FIG. 22 is disadvantageous in several respects. First, since the photoconductive elements are used as sources of drive signals for the individual pixel electrodes, the sources must be shaded. Second, the LEDs 317 which emit high-luminance optical signals and arranged in high density is necessary. Third, the array of photoconductive elements and LEDs generates pulses which rise and fall at a speed lower than those generated by a high-withstand voltage pulse generator IC by one or more order of magnitude. Fourth, the array of photoconductive elements and LEDs has voltage-current independence less than that of a high-withstand voltage pulse generator IC. Fifth, the photoconductive elements 321 must be connected by lines to the electrodes 303 immersed in ink and also to the TFT 322, limiting the electrostatic capacitance of the pixel electrodes 303 within an allowable range. As a consequence, the devices including the LEDs 317 need to be mounted in a complex manner and at a high density.

The greatest problem with this embodiment is that the interference electric field which disturbs the vector scan is generated. This interference electric field occurs since pixel electrodes are in a floating state while a reset signal is being supplied to the thin-film transistors, injecting carriers from one pixel electrode via the ink into the other pixel electrode. (Such interference does not occur in the embodiment of FIG. 20, in which the pulse generator IC 308 controls the potentials of the pixel electrodes 303.) To avoid the interference electric fields, ink of a low electric conductivity may be used so as to minimize the number of carriers injected into the pixel electrodes, and also the charge-accumulating time for each pixel electrode may be shortened. If this method is applied, the range in which the device can be used is extremely narrow due to response frequency of the device. Another method of preventing the interference electric field is to apply multi-phase reset signals to the thin-film transistors. If this alternative method is adopted, however, vector scanning is accomplished, but in one direction only. Still another alternative method is to control the grounding of the pixel electrodes by means of an array of photosensitive elements and an array of LEDs. This method would render the component mounting much more complicated.

The embodiments illustrated in FIGS. 20 and 22 are, so to speak, two prototypes of the recording apparatuses according to the second aspect of the present invention. Both remain to be improved. Other embodiments, greatly improved in structure and controllability and, thus, solving almost all problems inherent in the embodiments of FIGS. 20 and 22, will be described below, with reference to FIGS. 24 to 40.

Figure 24:
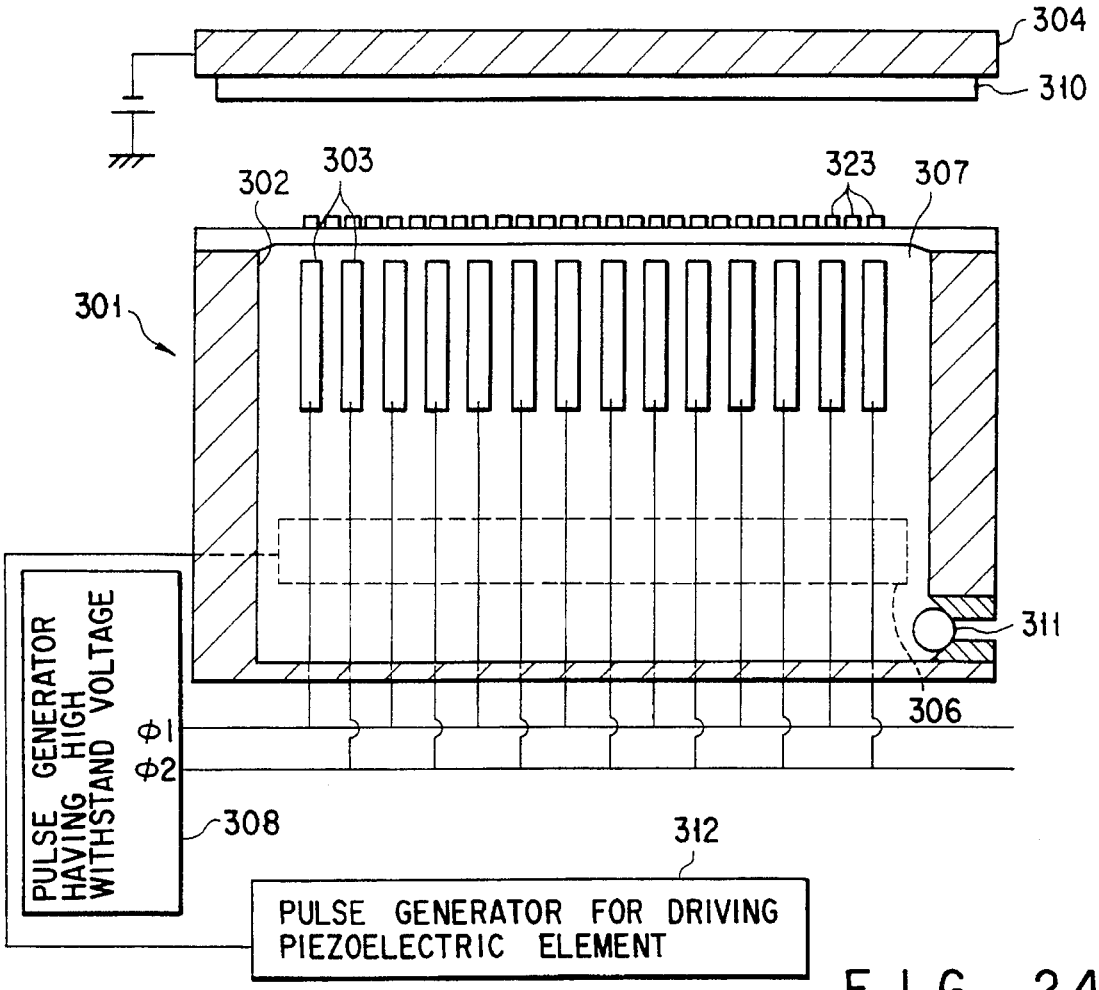
FIG. 24 is a sectional view showing a modification of the apparatus shown in FIGS. 20 and 22.

FIG. 24 is a sectional view showing a modification of the prototypes shown in FIGS. 20 and 22. The main characterizing feature of this apparatus resides in that an array of auxiliary electrodes 323 is provided in front of the common opening section 302.

The auxiliary electrodes 323 achieve four major advantages. First, they raise the response of the apparatus (3 to 7 times higher). Second, they realize bi-directional vector scanning. Third, they greatly reduce the current capacitance (charge) of high-voltage signals. Fourth, they suppress an electric field generated by injecting carriers into adjacent pixel electrodes through the ink.

In the modified embodiment shown in FIG. 24, the signals supplied to pixel electrodes 303 are two-phase, high-voltage signals (about 300 V) only. Image signals, which have vector scanning control components, are supplied to the auxiliary (gate) electrodes 323. A piezoelectric element 306 is located in the ink-holding section 1 performs the same function as in the embodiment of FIG. 20. However, in this embodiment, it is possible that dividing of ejected ink-droplets is controlled by only the gate electric fields generated by the auxiliary electrodes 323. Further, ink droplets can be deflected not only along the common opening section 302 but also along a line perpendicular thereto by creating imbalance between the potentials of any two auxiliary electrodes 323 which are driven in pair.

Figure 25:
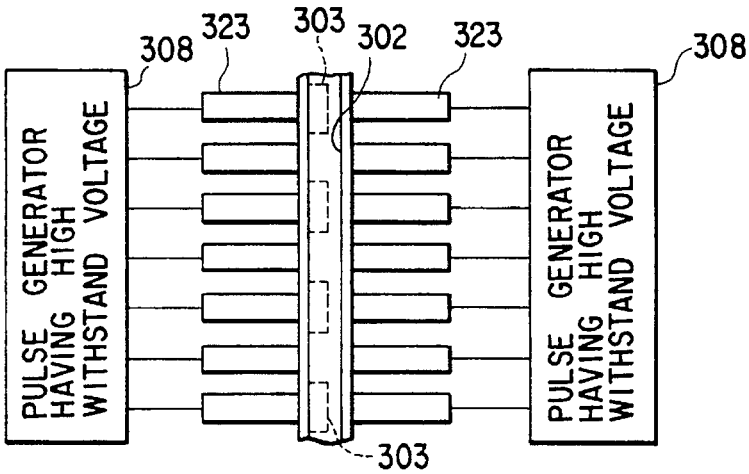
FIG. 25 is a diagram illustrating the positional relationship between auxiliary electrodes on the one hand, and the pixel electrodes on the other, all used in the ink-jet recording apparatus shown in FIG. 24.

FIG. 25 is a plan view representing the positional relationship which the auxiliary electrodes 323 assume with respect to the pixel electrodes 303. The embodiment of FIGS. 24 and 25 is similar to the conventional ink-Jet printer of electrostatic-attraction type, disclosed in IS&T, p. 343, 1992, but differs in structure on some points. Namely, the common opening 302 (i.e., a single slit) is used instead of the array of nozzles employed in the conventional ink-Jet printer, in order to effect vector scanning. In addition, it is preferable that a plurality of auxiliary electrodes 323 (at least one pair) are associated with each pixel electrode 303, whereas the auxiliary electrode associate with the pixel electrodes in one-to-one correspondence in the conventional ink-jet printer. As shown in FIG. 25, a pulse generator IC 308 having a high withstand voltage is connected, as a high-voltage signal source, to the pixel electrodes 303. However, pyroelectric material can be utilized, as will be explained in conjunction with other embodiments (later described), since the auxiliary electrodes 323 greatly reduce the current capacitance (charge) of the high-voltage signals (third advantage).

Figure 26A:
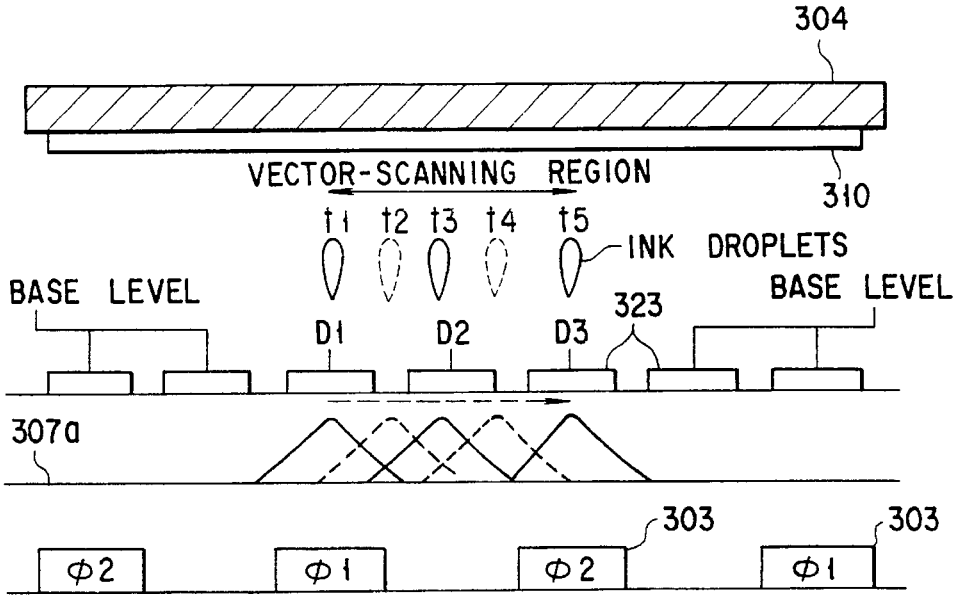
FIG. 26A is a diagram for explaining how the apparatus of FIG. 24 ejects ink droplets in a two-phase divisional drive mode.
Figure 26B:
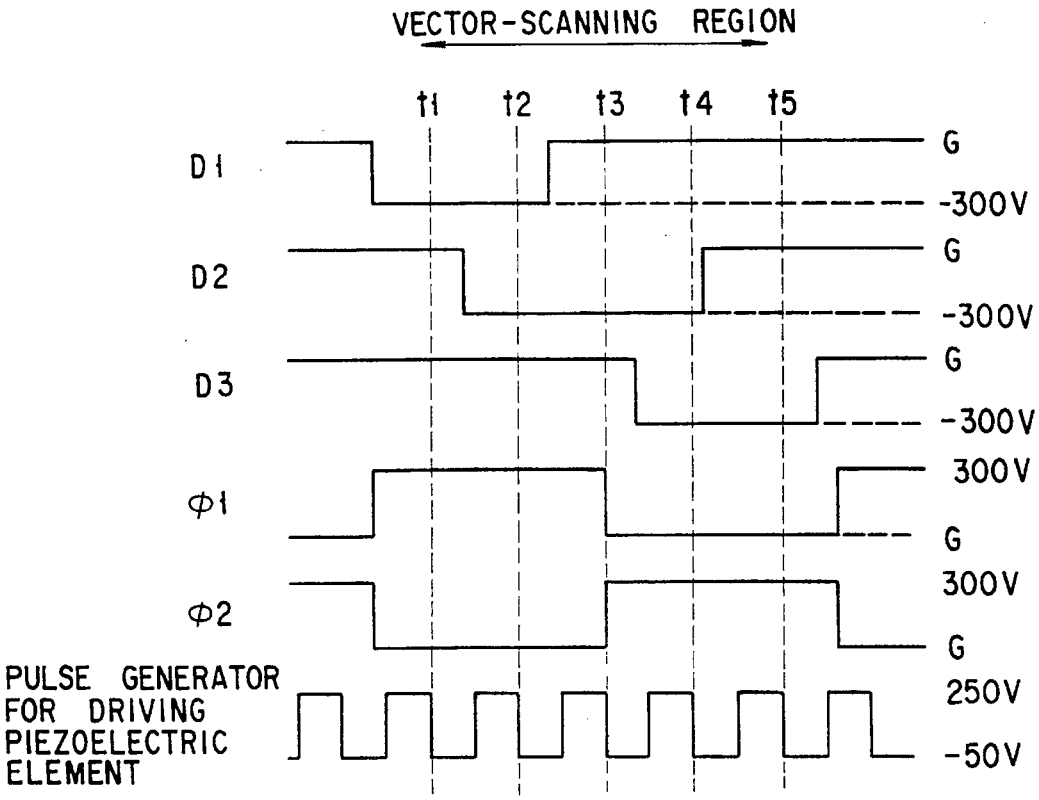
FIG. 26B is a timing chart showing the timing of generating high-voltage pulses when the apparatus of FIG. 24 operates in the two-phase divisional drive mode.

FIG. 26A explains the ink-ejection mode of the apparatus shown in FIG. 24, and FIG. 26B illustrates the timing of driving the electrodes of the apparatus. In this embodiment, the pixel electrodes 303 are driven in two-phase divisional drive mode, by applying voltages $\phi 1$ and $\phi 2$, and control signals and image signals are supplied to the auxiliary electrodes 323, to thereby accomplish vector scanning. FIGS. 26A and 26B also indicate the timing of supplying drive signals to the piezoelectric element 306, for vector-scanning any adjacent pixel electrodes 303. Needless to say, the frequency of these drive signals and the timing of supplying them may be changed for the purpose of performing more analog-like scanning among the pixels. Here arises a problem. As has been explained with reference to FIG. 21, the pulse generator IC 308 can hardly generate a voltage of level 2 or more, which may be applied to the auxiliary electrodes 323. Hence, analog scanning, if effected by any means, will be unstable. Embodiments using pyroelectric material, in which analog scanning can be well performed, will be described later.

The embodiment shown in FIG. 20 makes an error when vector scanning along a direction that outputs of adjacent pixels of the same phase combine together is performed. Thus, this vector scanning scheme is prohibited in the embodiment of FIG. 20, but not in the embodiment illustrated in FIGS. 26A and 26B. Due to the first advantage, i.e., the enhancement in the response (3 to 7 times higher), and the two-phase divisional drive, the line-scanning frequency is 1 to 2 kHz, which increases the scanning speed very much. Since the ink applies virtually no charge on the auxiliary electrodes, the electric charge each pixel electrode 303 requires is extremely small. There is no need of using a pulse generator IC which has a high withstand voltage and which has a large current capacitance. Pyroelectric material can, therefore, be used in the embodiment of FIGS. 24 and 25.

As is evident from FIGS. 25, 26A and 26B, the auxiliary electrodes 323 are arranged in density four times higher than the pixel electrodes 303. In other words, four auxiliary electrodes 323 are provided for each pixel electrode 303.

Figure 27:
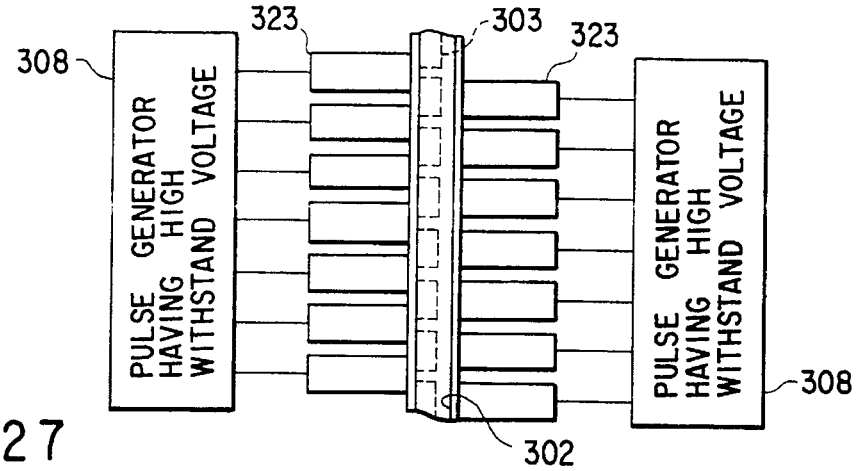
FIGS. 27, 28 and 29 are diagrams showing three alternative arrangements of the auxiliary electrodes and pixel electrodes used in the ink-jet recording apparatus illustrated in FIG. 24.
Figure 28:
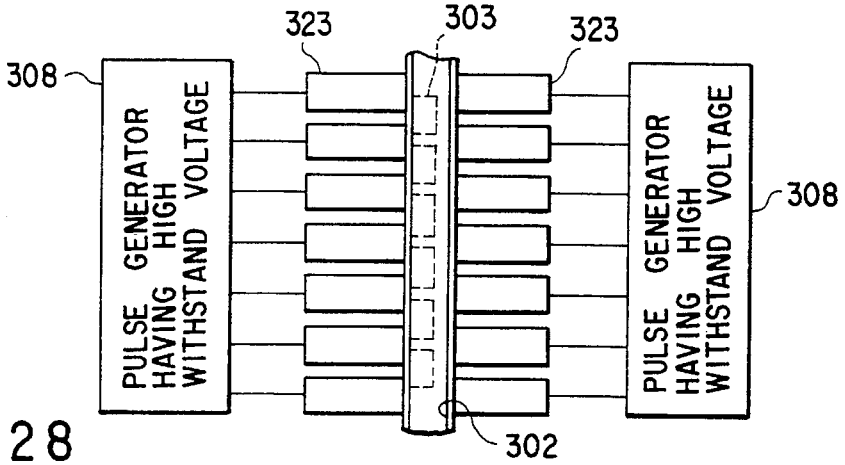

FIGS. 27 and 28 show two other embodiments which differ from these embodiment in that the auxiliary electrodes 323 are arranged in density twice higher than the pixel electrodes 303. In these embodiments, a phase difference is set between the voltage applied to auxiliary electrodes 323 arranged on one side of the common opening 302 and auxiliary electrodes 323 arranged on the other side of the common opening 302, and the pixel electrodes 303 are scanned in the main-scanning direction.

Figure 29:
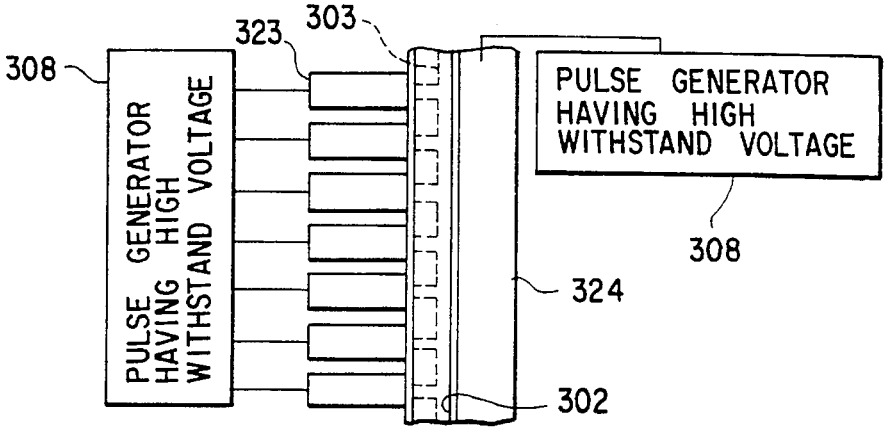

FIG. 29 illustrates another embodiment which is characterized in that auxiliary electrodes 323 are arranged on only one side of the common opening section 302 and a common auxiliary electrode 324 is arranged on the other side thereof, and the auxiliary electrodes is used in a number slightly greater than that of the pixel electrodes 303, at the expense of the scanning efficiency.

Figure 30:
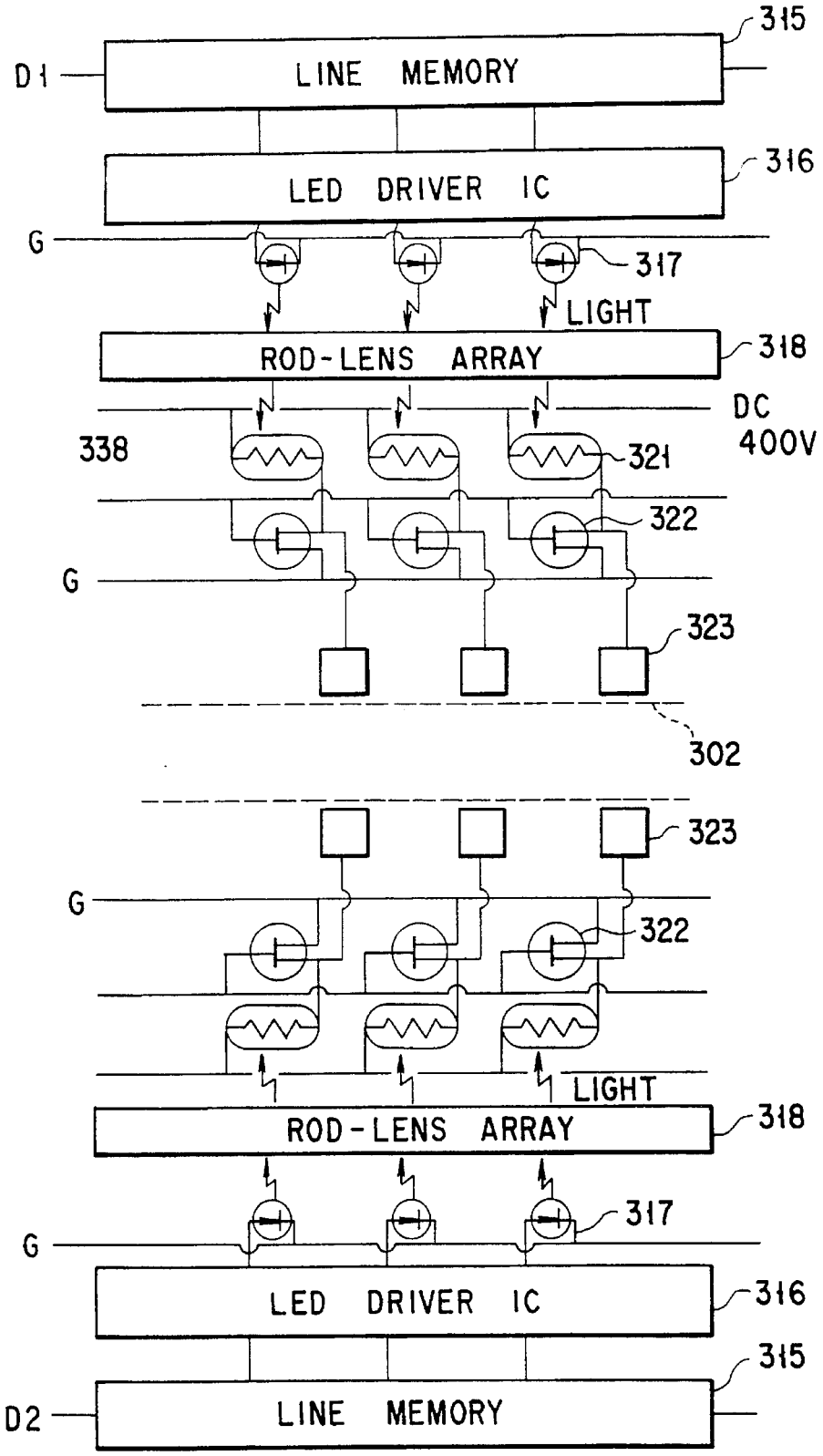
FIG. 30 is a block diagram showing an ink-jet recording apparatus which is identical in structure to the apparatus of FIG. 24 and which comprises a photosensitive elements and light-emitting elements.

FIG. 30 is a circuit block diagram showing still another embodiment which comprises photosensitive an array of elements 321 and LEDs 317, used in place of pulse generators having a high withstand voltage. This embodiment is similar to that of FIG. 22, but characterized in that two drive circuits are provided and that each drive circuit is located at one side and outputs a control signals and image signals.

With this embodiment it is possible to control the width and duty of LED-driving pulses, ultimately to adjust the amount of the light applied on the photosensitive elements 321. Thus, the voltage of the pixel electrodes 303 can be changed. This makes it possible to scan the pixels in more analog-like fashion than in the case the pixel electrode are directly driven by the pulse generator IC. The present embodiment is, however, disadvantageous in some respects. First, the photosensitive elements used as sources of drive signals for the pixel electrodes must be shaded. Second, the LEDs 317 must emit high-luminance optical signals and be arranged in high density. Third, the array of element 321 and LEDs 317 generates pulses which rise and fall at a speed lower than those generated by a high-withstand voltage pulse generator IC by one or more order of magnitude. Fourth, the LED driver 316 has voltage-current independence less than that of a high-withstand voltage pulse generator IC.

Nonetheless, in this embodiment, carriers are not injected from any pixel electrode into adjacent pixel electrodes trough the ink as in the embodiment of FIG. 22. Thus, the embodiment is free of the greatest problem with the embodiment of FIG. 22, i.e., no interference electric fields are generated. Furthermore, since the auxiliary electrodes 323, the photosensitive (photoconductive) elements 321, and TFTs 322 can be formed in the same plane, the components can be mounted much more easily than in the embodiment of FIG. 22. In the apparatus of FIG. 30, too, the photosensitive (photoconductive) elements 321 should be made of hydrogenated amorphous silicon (a-Si:H). The TFTs 322 can be replaced by switching elements having a high withstand voltage, unless their use increases the manufacturing cost of the apparatus, along with the use of the pulse generator IC.

Figure 31:
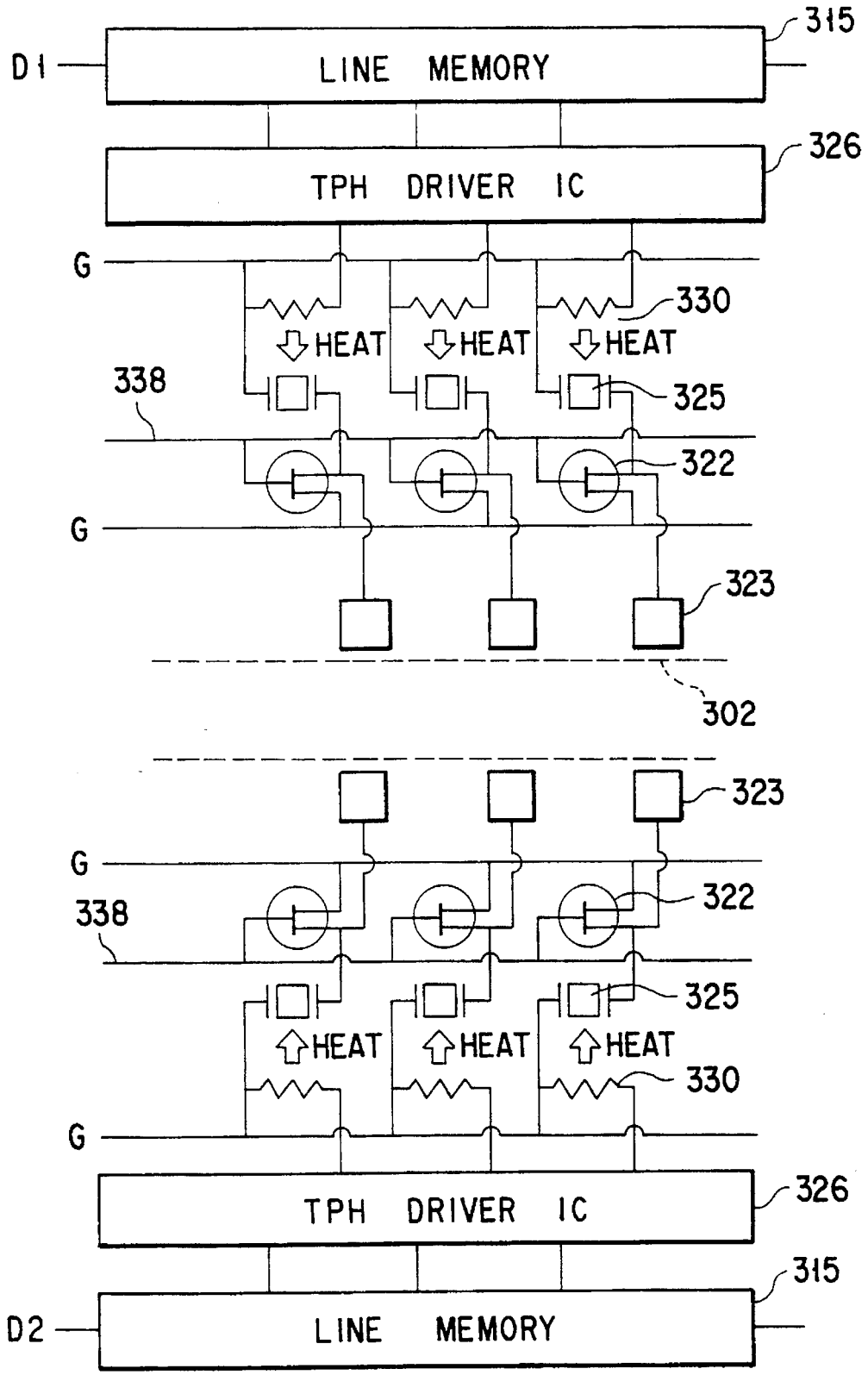
FIG. 31 is a block diagram showing an ink-jet recording apparatus which is identical in structure to the apparatus of FIG. 24 and which comprises pyroelectric elements and a thermal printer head (TPH)

FIG. 31 is a circuit block diagram showing a further embodiment which comprises pyroelectric elements 325 used in place of a pulse generator IC, for driving auxiliary electrodes 323. As shown in FIG. 31, a thermal printer head (MPH) driver 326 supplies power to heat-generating resistors 330 in accordance with the control signal and the image signals read from a line memory 315. The resistors 330 generate heat, which is applied to the pyroelectric elements 325. Each pyroelectric element 325 generates an electric charge which changes almost linearly to its temperature change. The electric charge is applied to the corresponding auxiliary electrode 323. The auxiliary electrode 323 accumulates the electric charge and generates a voltage. Unlike the embodiment incorporating photosensitive elements and an LED array, the present embodiment does not require power-supply lines for applying potentials to the auxiliary electrodes 323. The voltage of the auxiliary electrode 323 rises as electric charge accumulates in the electrode 323. When the charge increases above a critical value, ink ejection starts under an electrostatic force. The normal voltage of the auxiliary electrodes 323 is determined by the which is generated at normal temperature of the pyroelectric elements 25 and the capacitance of the auxiliary electrodes 323. The capacitance of each auxiliary electrode 323 is univocally determined by the physical properties, size and shape of the pyroelectric elements 325.

The temperature of each pyroelectric element 325 can be controlled by changing the width and duty of the drive pulses supplied from the TPH driver 326. Therefore, the voltage of each auxiliary electrode 323 can be controlled by the output of the TPH driver 326. In this embodiment, the changes in the voltage of each auxiliary electrode 323 can be suppressed by controlling the thermal hysteresis of the TPH driver, as is practiced in thermal printing. Also, the difference in voltage among the auxiliary electrodes 323, cause by the difference in properties among the pyroelectric elements 325 and the heat-generating resistors 330 or the like, can be minimized by correcting the image signals in accordance with the data which is stored in a memory (not shown) and which represents the difference in properties among the elements 325 and 330.

The charges are transferred from the auxiliary electrodes 323 to a ground line via the TFTs 322, whereby the auxiliary electrodes 323 are placed in reset state. At the same time the electrodes 323 are thus reset, the pyroelectric elements 325 may be heated to cause the auxiliary electrodes 323 to generate a potential of the opposite polarity. The reference potential for the auxiliary electrodes 323 is the ground potential in this embodiment. Alternatively, the reference potential may be a sum of an offset potential of positive or negative polarity and the ground potential. Each TFT 322 can be replaced by a switching element having a high withstand voltage or by a unit comprised of a photosensitive element and a light source, unless their use increases the manufacturing cost of the apparatus, along with the use of the pulse generator IC. Each TFT 322 may be replaced by combination of photosensitive member and light source, or ion source.

The pyroelectric elements 325 may be formed of an inorganic or organic film having a thickness of about 5 to 100 microns. They can be made of those materials exemplified in connection with the embodiments according to the first aspect of the present invention. Organic film has a low dielectric constant (e.g., 35 for TGS) and can be formed by a low-cost process, but has a low Curie point (e.g., 49° for TGS) and the highest temperature at which it can be used or processed is comparatively low. Inorganic film may be either a single-crystal film or a ceramic film. Single-crystal film has a low dielectric constant (e.g., 43 for $LiTaO_3$) and has a high Curie point (600° C. for $LiTaO_3$), but is difficult to form. On the other hand, ceramic film has a high Curie point (e.g., 470° C. for $PbTiO_3$, and 200° C. for PZT) and can be formed relatively easily, but has a high dielectric constant (e.g., 200 for $PbTIO_3$, and 380 for PZT). In view of these facts, it is recommendable to select and use inorganic ceramic film. (PZT is a better choice than any other material mentioned above.)

Semiconductor that can be used as material for the TFTs 322 may be either a hydrogenated amorphous silicon (a-Si:H) or a polycrystalline silicon. Each material has merits and demerits. Hydrogenated amorphous silicon is desirable in that is has high resistivity (off-resistance) and can be processed into a film at low temperatures. Polycrystalline silicon is advantageous in that it can provide a TFT having a large on-current, has a carrier mobility one or more orders higher than that of hydrogenated amorphous silicon, and remains stable during a high-temperature process. Therefore, polycrystalline silicon exhibits a fast response and can be processed at 200° or more even after TFTs have been fabricated in it. Which material, hydrogenated amorphous silicon or polycrystalline silicon, should be used is determined by the structure of the TFT and the method of manufacturing the TFT.

Figure 32:
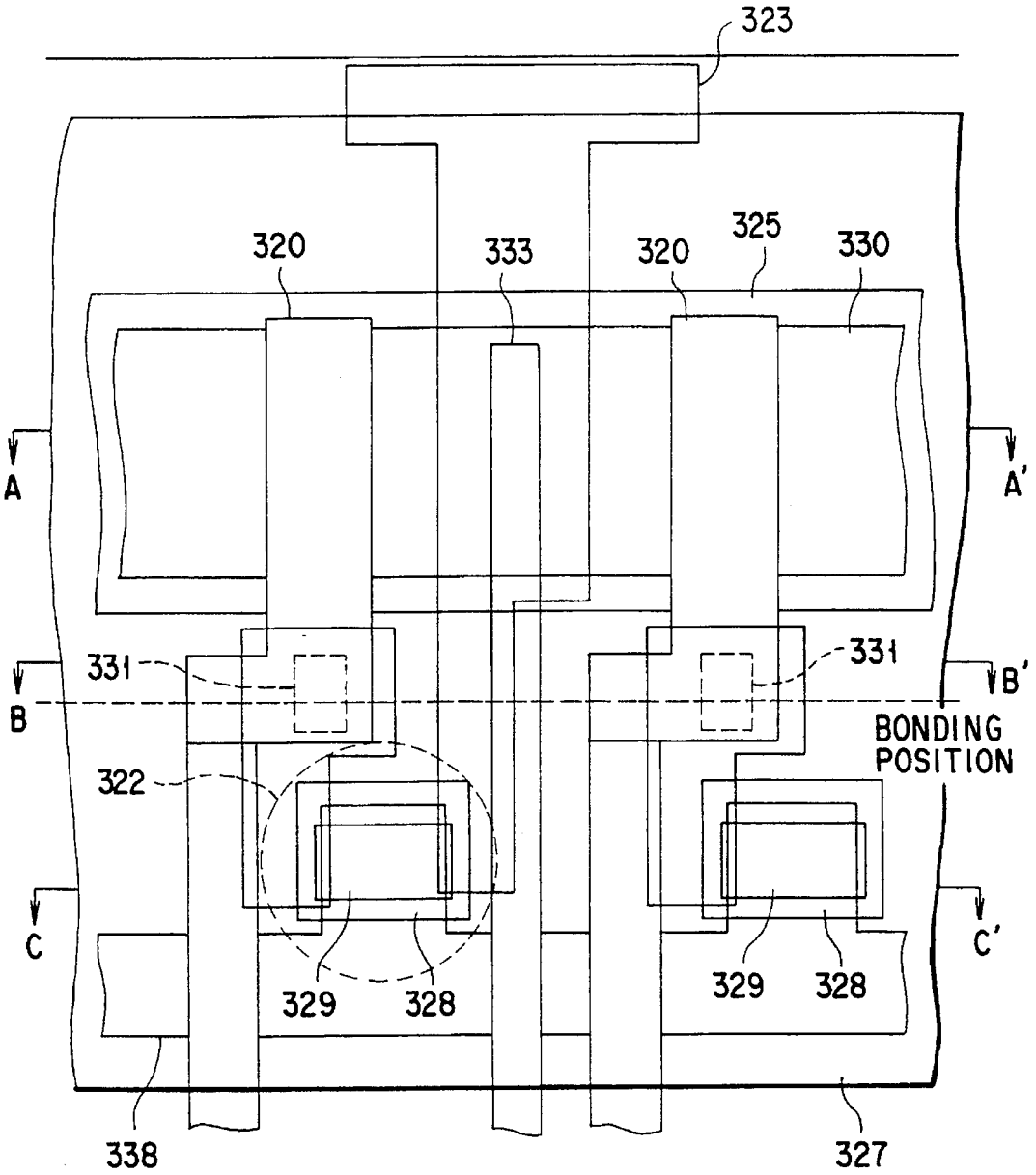
FIG. 32 is a plan view illustrating the auxiliary electrodes and adjacent components of the ink-jet recording apparatus shown in FIG. 31.

FIG. 32 is a plan view illustrating the auxiliary electrodes 323 and adjacent components of the recording apparatus shown in FIG. 31. As is clearly seen from FIG. 32, the pyroelectric films 325 are mounted on the auxiliary electrodes 323; the heat-generating resistors 330 are laid upon the pyroelectric films 325; current-supplying lines 333 are connected to the resistors 330; ground lines 320; and the TFTs 322 connects the auxiliary electrodes 323 to the ground. As shown in FIG. 32, each of the pyroelectric elements 325 and the corresponding resistor 330 are not separated. Heat is generated by supplying an electric current through those portions of the film 330 which are located among the current-supplying lines 333 and the ground lines 320. This thermal printer head (TPH) need not to have a anti-abrasion layer at its surface, but is preferably covered with an anti-oxidation film (not shown). Needless to say, it is preferable that each of the films 325 and the corresponding resistor are separated 330 when it is intended that sensitivity of elements is increased and difference of characteristics of elements is decreased, unless the cutting process increases the manufacturing cost too much. If this is the case, the resultant elements have a capacitance smaller and a less characteristic difference.

Figure 33A:
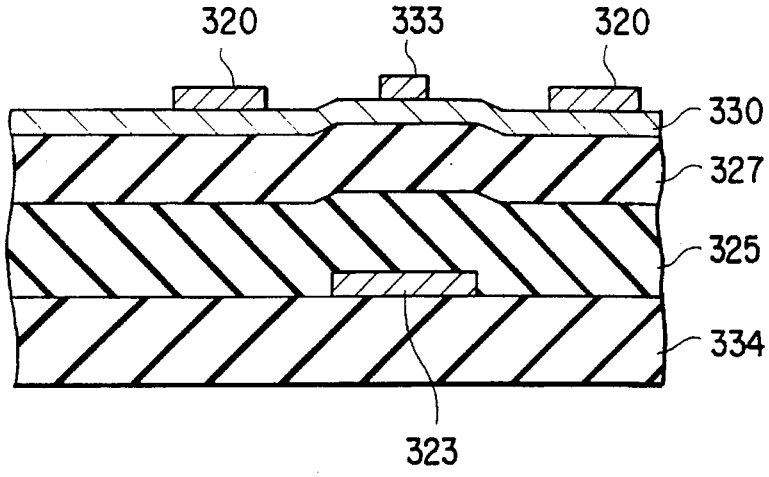
FIGS. 33A, 33B and 33C are sectional views of the structure shown in FIG. 32, taken along line A–A', line B–B' and line C–C', respectively.
Figure 33B:
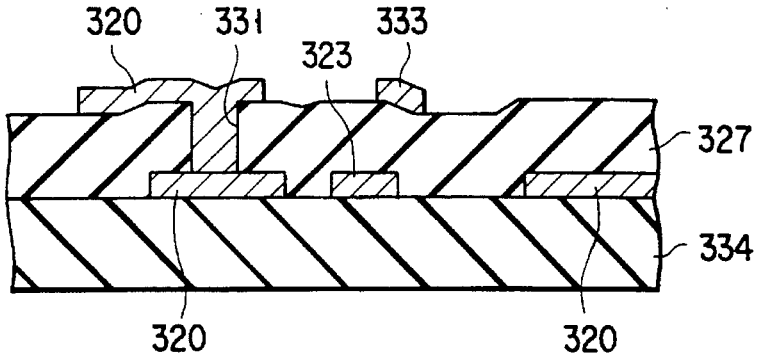
Figure 33C:
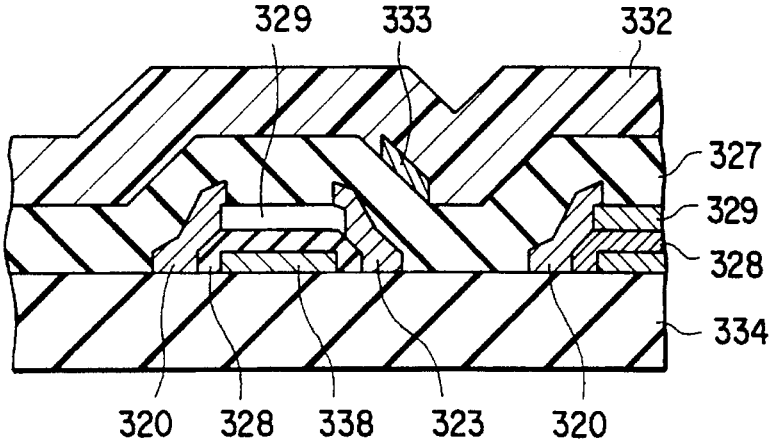

The pyroelectric films 325 is formed by screen-printing inorganic ceramic and sintering the printed inorganic ceramic. The sintered inorganic ceramic have a rather rough surface. Smoothing film 327, which are electrically insulator, are provided on the inorganic ceramic. The films 327 is used as electrically insulating films which insulate between the lines having different potentials. The heat-generating resistors 330 have been formed by sputtering TaOx, for example, as in the ordinary thermal line printer heads. The TFTs 322 comprises a semiconductor film 329 of an a-Si:H. The apparatus further comprises an insulating film 328 which is made of $SiO_2$ (or $Si_3N_4$). Since the TFTs 322 have a semiconductor film 329 of a-Si:H, they are sensitive to light. Therefore, the TFTs 322 are covered with a junction coating resin (JCR) 332 having shading property. FIGS. 33A, 33B, and 33C show the structure shown in FIG. 32, taken along line A–A', line B–B' and line C–C', respectively.

Figure 34:
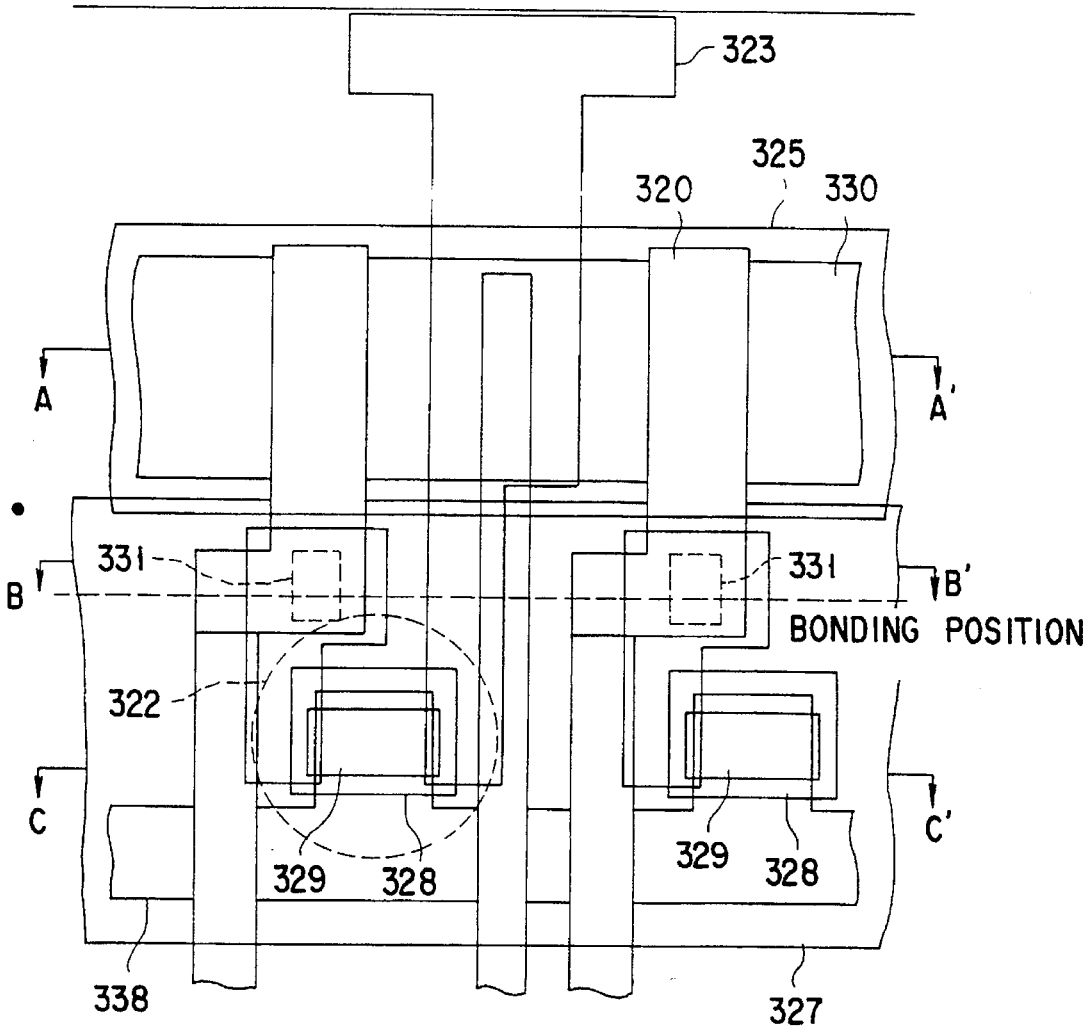
FIG. 34 is a plan view representing a modification of the structure shown in FIG. 32.
Figure 35:
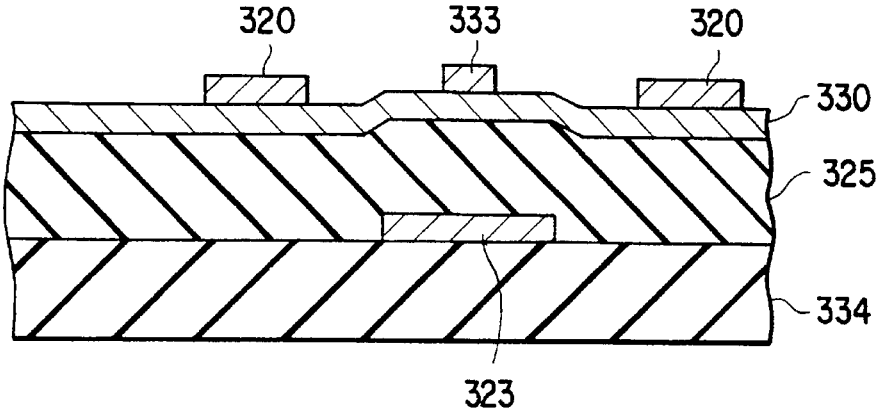
FIG. 35 is a sectional view of the structure shown in FIG. 34, taken along line A–A' in FIG. 34.

In the case where the pyroelectric elements 325 have a sufficiently smooth surface and exhibit an adequate insulating property, the heat-generating resistors 330 may be provided directly on the pyroelectric elements 325, as is illustrated in FIG. 34. In this case, the apparatus assumes the cross-sectional structure shown in FIG. 35, taken along line A–A' in FIG. 34. Its cross-sectional structures, taken along lines B–B' and C–C', are identical to those shown in FIGS. 33B and 33C.

If the apparatus incorporates a high-density thermal printer head (TPH), the influence of the heat radiating from adjacent dots is problematical. In the case of a thermal line printer head, all resistors to be driven to print a line of pixels must be arranged in a line. In the present embodiment, carriers induced by heat are used to print data, the heat-generating resistors 330 need not be arranged in a line. The resistors 330 can be arranged in a matrix pattern, such that they are spaced from by as long a distance as is permitted by the electrostatic capacitance (sensitivity) of the elements. Hence, the influence of the heat radiating from adjacent dots can be suppressed.

The present embodiment solves incorporates no pulse generator IC having a high withstand voltage, which is an expensive device. Furthermore, it is free of problems inherent in any apparatus comprising photosensitive elements and light-emitting elements, e.g., shading of the photosensitive elements and complex mounting of the photosensitive elements, the light-emitting elements and rod-lens array. In view of this, the present embodiment is more advanced than any other embodiment according to the second aspect of the present invention.

Two modifications of the percent embodiment will be described, with reference to the circuit block diagrams of FIGS. 36 and 37.

Figure 36:
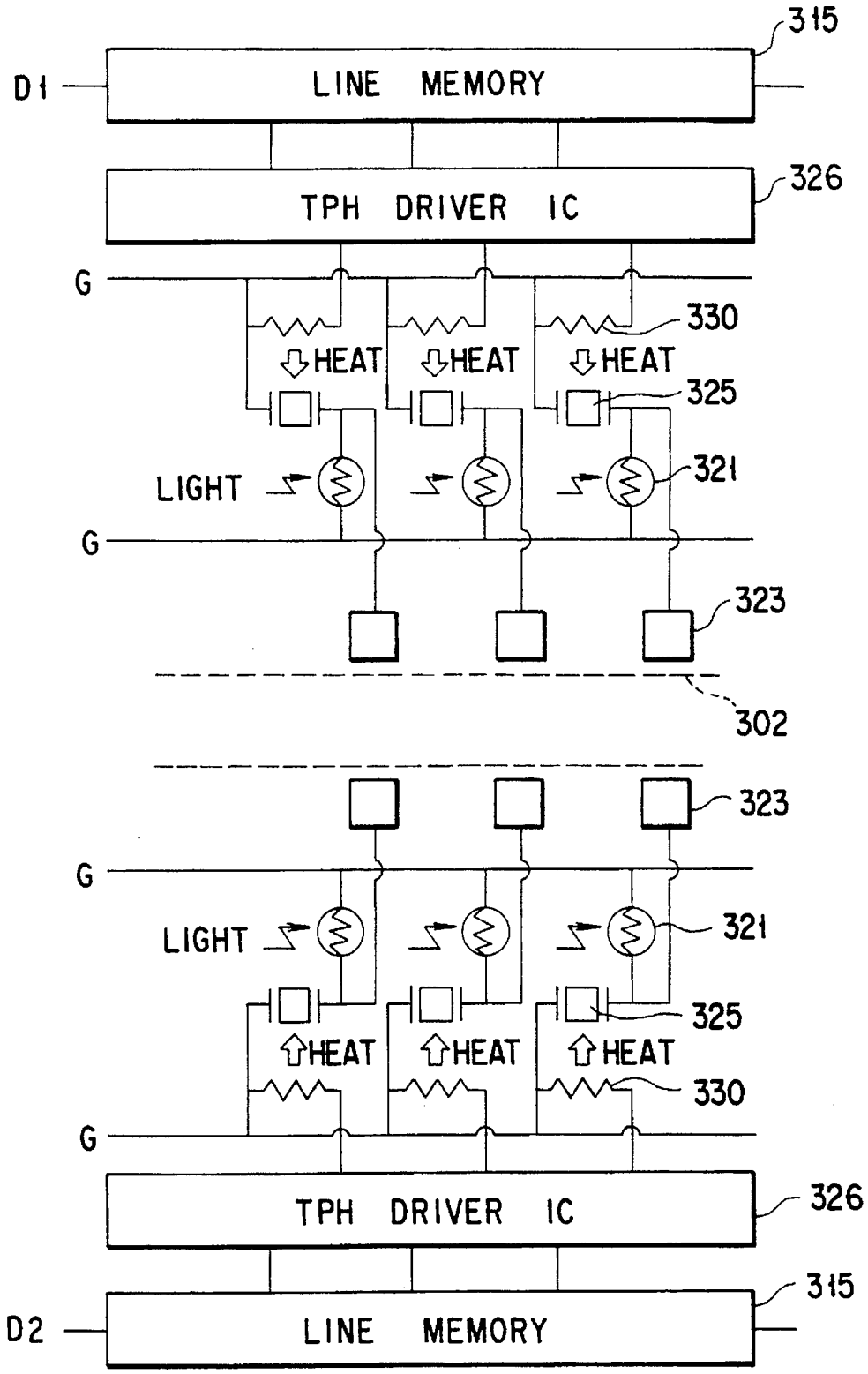
FIG. 36 is a block diagram showing a modification of the apparatus shown in FIG. 31.
Figure 37:
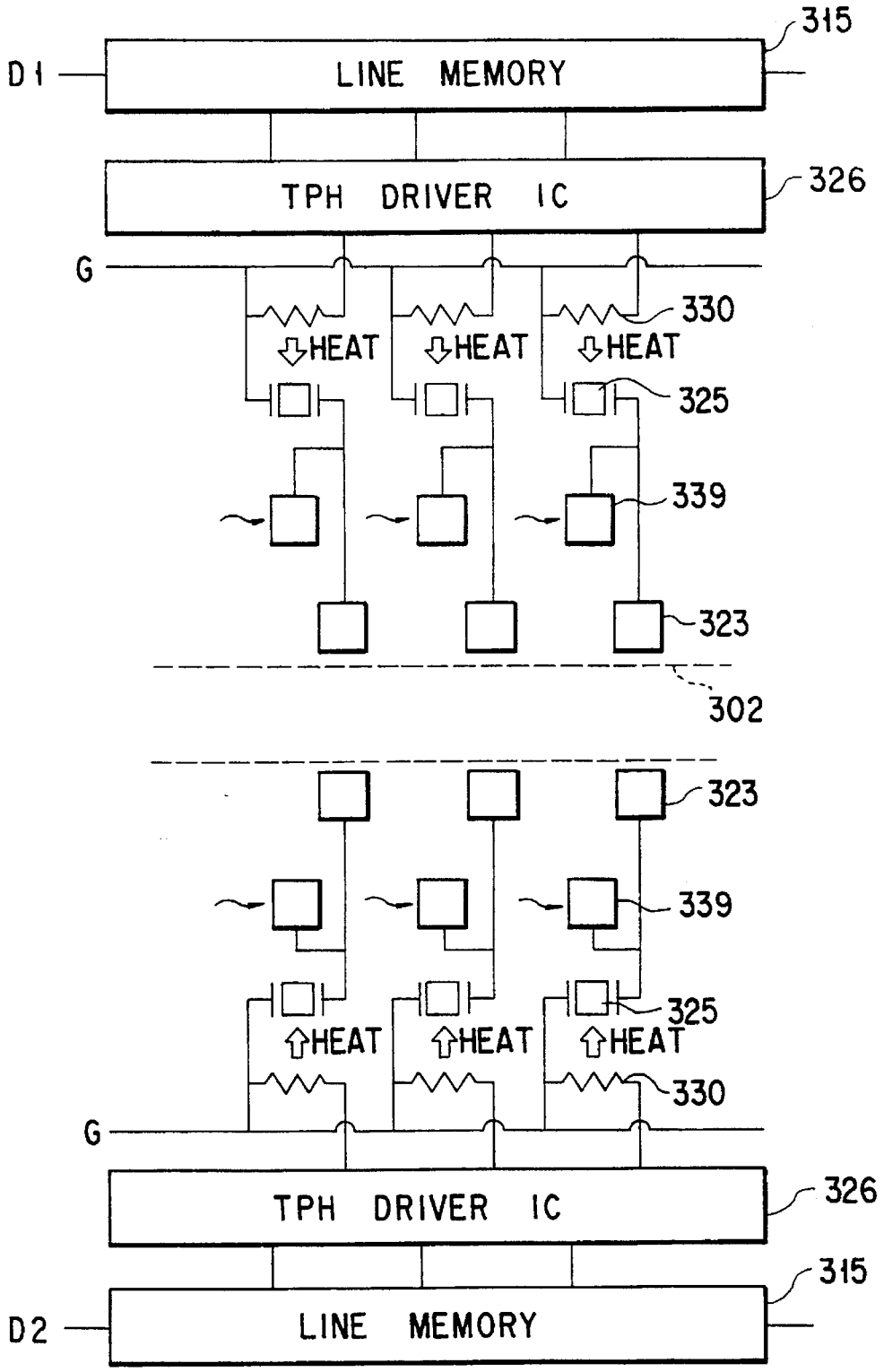
FIG. 37 iS a block diagram depicting another modification of the apparatus shown in FIG. 31.

In the modified recording apparatus of FIG. 36, photosensitive elements 321 and a light source (not shown) are used as reset circuit, in place of an TFT array. In the modified apparatus shown in FIG. 37, ion sources 339 are utilized in place of an TFT array.

Although the embodiment of FIGS. 31 and 32 is the most advanced apparatus according to the present invention, it records but fluctuation is generated in the recorded image.

Any recording head having elements for forming dots, for example, an optical head of line-scan type whether a ink-jet head, a thermal head, electrophotographic apparatus prints dots different in depth. (Two types of scanning of an optical head are known. The first type, called "serial-scan type," is designed for serial-scan recording, wherein a recording energy source, such as the optical system of a laser printer, is moved in both the main scanning direction and the sub-scanning direction, thus performing raster scanning. The second type, called "line-scan type," has a plurality of recording elements juxtaposed in the main scanning direction. The recording elements are used to print dots forming a line extending in the main scanning direction, and each is used to print dots forming a line extending in the sub-scanning direction. Among the line-scan heads known are: a liquid-crystal shutter array, an LED array and an EL array, a thermal head for use in facsimile, and an ink-jet nozzle of the type used in the second aspect of the present invention.)

In the present invention. In the recording apparatus in which a line-scan device having an array of elements is used such as the second aspect of the present invention, the direction in which ink droplets are ejected from the nozzle are controlled so that all dots printed may be uniform in terms of depth. Compensation of the depth difference among the dots for the above control is not performed in any conventional recording apparatus. However, a method of compensation of the depth difference which is problem generating in a printer for gradation recording having high quality image among the printed dots, like the above method, is known.

In the case of analog, high-density color image recording using sublimating ink, the depth difference among printed dots are related to the resistance difference among the thermal elements. The resistances of the individual thermal elements are measured, and a ROM table of the resistances is used, in order to minimize the difference in depth among printed dots.

In the case of electrophotographic recording, too, the outputs of the light-emitting elements of the optical head are measured, and a ROM table of the these outputs is used to reduce the difference in depth among printed dots.

These methods consisting in using a compensation ROM table are feasible. However, it requires much time and labor to determine the characteristics of the elements of the head. This inevitably increases the cost of manufacturing the recording apparatus incorporating the head. Furthermore, no measures are taken to assure for the changes in the characteristics of the elements which occur with time.

The electrodes which control the direction in which ink droplets are ejected and which are provided a tip portion of the nozzle impose the greatest influence on the fluctuation of the image recorded. In the embodiment of FIGS. 31 and 32, the heat-generating resistors and pyroelectric elements are used for generating voltages. Not only the difference in resistance among the heat-generating elements, but also the difference among the pyroelectric elements in terms of current-generating ability affect the quality of the image recorded.

To detect these difference and accomplish closed-loop control of these differences, a voltage-detecting system is required which comprises resistor elements for dividing a voltage, and a high input-impedance analog voltage detecting circuit and an A/D converter. The system need to be provided for each element for a dot. Only one system is sufficient for all dots or each IC used for driving elements. In this case, it is necessary to use an analog gate. (The analog gate is one comprising switching elements for allowing or prohibiting passage of the analog input signals, which are in most cases field effect transistors (FETs) having a low impedance when turned on.)

Figure 38:
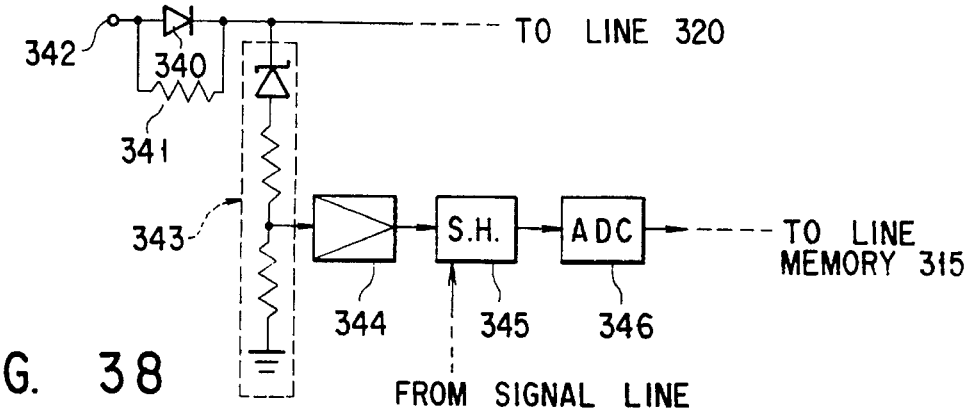
FIG. 38 is a circuit diagram showing a control circuit for preventing the deforming of an deformed image.

FIG. 38 shows a control circuit of this type, which is incorporated in the apparatus of FIG. 31. The control circuit uses the reset ground line which is one of the ground lines 320 of the apparatus shown in FIG. 31 as a reset power supply line 320'. To the reset power-supply line 320', there are connected two circuit units. The first circuit unit is connected to a bias power supply 342 by a common diode 340 and a common resistor 341. The second circuit unit is connected to a serial output A/D converter 346 by a common voltage shift circuit 343, a common amplifier 344 and a sample-and-hold circuit 435. Signals output from the A/D converter 346 are input to the line memory 315. The sample-and-hold circuit 345 is connected to the reset-pulse signal lines 338. In the apparatus of FIG. 31, each TFT 322 connected to one of the two electrodes sandwiching the pyroelectric element 325 is bi-directional. Thus, a bias having voltage of the value immediately before an ink drop is ejected is always applied to the TFT. This is why the bias power supply 342 is connected to the reset power-supply line 320'. The common diode 340 supplies a current to the line 320' as soon as the voltage on the line 320' falls below the voltage applied from the power supply 342, and makes it possible to detect the voltage on the line 320' when this voltage rises above the voltage applied from the power supply 324. The common resistor 341 connected in parallel to the common diode 340 has such a resistance as to resume normal condition to match the voltage of the auxiliary electrodes 323 with the bias voltage—immediately after its voltage has change for a short transient period required to detect the voltage of the reset power-supply line 320'. The transient period is determined by the electrostatic capacitance of the auxiliary electrodes 323 and the CR time constant of the system comprising TFTs 322, the common resistor 341, and the like.

The common voltage shift circuit 343, which is the other connector circuit, is a serial circuit of a low-voltage diode and a resistor. The diode removes a bias of high voltage and takes only a change value of voltage. The resistor is a tapped resistor, so as to change a voltage change to a voltage which is appropriate as the input voltage of the voltage detecting circuit. The output voltage of the circuit 343 is amplified by the common amplifier 344. The amplified voltage is applied to the sample-and-hold circuit 345. The circuit 345 stabilizes the voltage upon receipt of a reset pulse input via the reset-pulse signal lines 338. The voltage, thus stabilized, is input to the serial output A/D converter 346. The output signal of the converter 346 is supplied to the line memory 315.

Generally, a line memory used in an ordinary TPH driver receives a drive signal from the line memory connected to a TPH driver IC located on the left side and supplies the drive signal to the line memory connected to a TPH driver IC located on the right side. In the present embodiment, however, the line memory 315 is equipped with a switching circuit which supplies a signal to the serial output A/D converter 346 while no signals are being supplied to the TPH driver 326 set in phase opposite to drive timing. In other words, the line memory 315 is modified to function as an interface as well.

From the data read from the line memory 315, an external control circuit determines an appropriate amount of energy to be supplied to each heat-generating resistor 330. The amount is stored in a memory, thereby compensating the changes in the characteristics among the elements and change in the characteristics of each element with time. Thus, the external control circuit can always output an appropriate control voltage.

The signal compasation achieved using such a simple circuit is an advantage inherent in the present system whose output is a voltage. By contrast, in a thermal head which outputs heat or an optical head which outputs a light beam, when a feedback circuit having a sensor for achieve self-control. is mounted on a thermal head or an optical head, the feedback circuit can hardly be fabricated in the form of an IC and has a complicated detection scheme and is unsuitable in structure. Therefore, it is impractical to use the feedback circuit.

If the sensor is to detect temperature, it must be a thermistor or a thermocouple. A thermistor usually has characteristics different from the design values. A thermocouple can hardly be incorporated into an IC. If the sensor is to detect a resistance, it must have a very occur reference resistor connected in series to an element in order to measure the resistance of that element. Whether the sensor is to detect temperature or resistance, it measures the magnitude of an electric current. In view of the resistance of the required wiring, a plurality of sensors of this type can hardly share a single analog gate. As a consequence, a large-scale analog circuit needs to be employed.

If the sensor is to detect an amount of light, it must have a plurality of photosensitive elements, inevitably increasing the size of the circuit. Besides, it is difficult to position the photosensitive elements without blocking light beams being applied to a recording medium.

In the present embodiment, since the energy applied to the recording elements is a voltage, the outputs from the elements corresponding to a number of dots can be sequentially input to a common circuit in time division. Thus, a feedback control system is made possible which can correctly compensate for the difference in depth between printed dots and the characteristics changes with time of the elements.

In addition, the voltage-detecting circuit system can be simple in structure and manufactured at low cost, unless it is required to respond fast. If incorporated into the drive circuit IC, it would not greatly increase the manufacturing cost of the apparatus. It is sufficient for the circuit system to respond about one pixel per millisecond. More specifically, in order to record data on a A4-sized paper sheet in portrait mode at a resolution of 300 dpi, about 3600 dots must be printed in one line. Since two sets of electrodes, i.e., the upper electrodes and the lower electrodes, are provided, it is necessary to measure the voltages of 7200 elements. Nevertheless, it takes the common circuit only 7.2 seconds to measure the voltages of the elements. When drive ICs are used, each for driving 128 elements or 64 elements, it takes each drive IC only 0.1 second to measure these elements. This period of time is sufficiently short in the case of comparative long timing such as the set-up time of the recording apparatus.

In the embodiment described above, an array of TFTs is used as a short-circuiting circuit for periodically remove charge from the electrodes. The short-circuiting circuit functions as an analog gate, too. Instead, another array of TFTs may be provided in parallel to the first array of TFTs. A circuit used in a thermal head in order to drive heat-generating elements has a shift register and a latch and converts a serial control signal to a parallel signal to drive elements in synchronization. A slight design change of this circuit suffices to constitute an interface which outputs the outputs of an A/D converter through a shift register.

The embodiment of FIG. 38 is no more than one example of the apparatus, in which an analog gate and an output shift register can be used in common. Any other circuit that comprises an analog gate, an A/D converter and output shift registers and that performs a required function can attain the same advantage.

Figure 39:
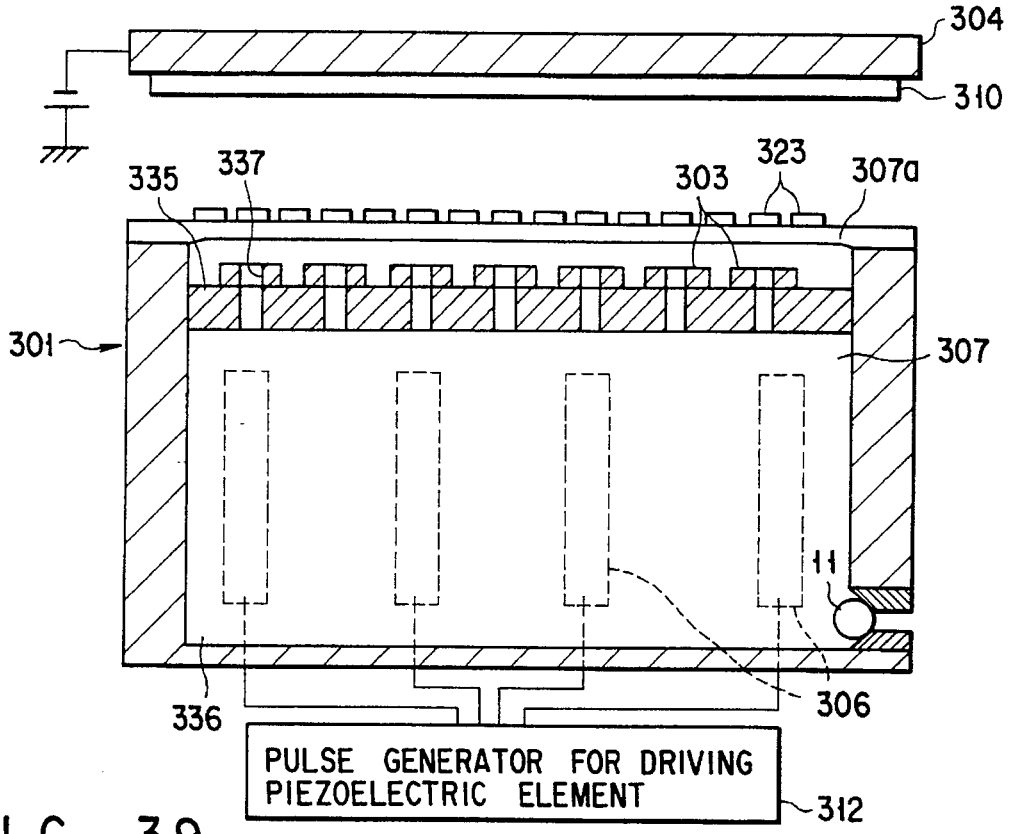
FIG. 39 is a sectional view showing still another type of the ink-jet recording apparatus according to the second aspect of the present invention.

Another embodiment, wherein the present is applied to a high-speed ink-jet head array invented by the present inventor and disclosed in Jpn. Pat. Appln. KOKAI Publication No. 5-269992, will now be described with reference to FIG. 39. FIG. 39 is a schematic representation of an ink-jet recording apparatus according to this embodiment. This embodiment is so improved as to increase link-ejection speed and to control of dividing of ink droplets more reliably. To be more specific, a partition member 335 is located in the ink-holding section 301, thereby defining a pressure chamber 336. Nozzles 337 for forming ink streams are made in those portions of the partition member 335 on which pixel electrodes 303 are mounted, and each of the nozzles 337 passes through the corresponding pixel electrode 303. Ink can therefore be periodically ejected through these nozzles 337. Measures are taken to temporarily form projections on a meniscus in each nozzle 337.

Figure 40:
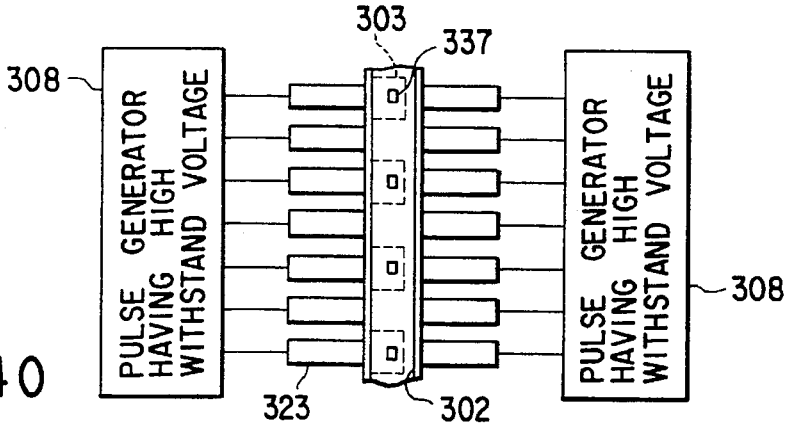
FIG. 40 is a diagram illustrating the positional relationship of the electrodes incorporated in the apparatus shown in FIG. 39.

Thus, ink can be ejected 2 to 5 times faster than in the case where menisci are formed by virtue of an electrostatic force alone, and dividing of ink droplets can be more reliably controlled than in the case where only an electrostatic attraction acts on the ink. FIG. 40 is a plan view illustrating the positional relationship among auxiliary electrodes 323, pixel electrodes 303 and nozzles 337.

A cleaning mechanism which effectively operates in an electrostatic attraction type ink-Jet head array, the typical example of which is a slit-jet type, will be explained. The clearing mechanism comprises at least one means for changing the volume of the ink-holding section, to thereby shift the position of an ink meniscus in the common opening section (slit); and means for wiping the common opening section along the slit with an elastic cleaning member, either periodically or sequentially. Before wiping the common opening section, the mechanism increases the volume of the ink-holding section, moving back the position of the meniscus from the slit position, preferably by a distance three or more times the slit width. Then, the mechanism wipes the common opening along the slit, while keeping the ink out of contact with the strip-like members, thereby removing dirt and foreign matter from the surfaces of the slits and, thus, preventing clogging. In this case, it is desirable that the portion of the cleaning member, which contacts the common slit, be changed in sequence so that a new cleaning surface may contact in every wiping process.

Since the cleaning mechanism can remove dirt or foreign matter from the surfaces of the slit, clogging will scarcely occur. The cleaning mechanism helps to enhance the reliability of a line-type ink-jet head array, and thus greatly serves to encourage the practical use of the line-type ink-jet head array. Furthermore, when the mechanism wipes the common opening section keeping the ink out of contact with the strip-like members, and when a new cleaning surface of the cleaning member contacts in every wiping process, the wiping member can have a long lifetime and need not be replaced so frequently.

An embodiment of the cleaning mechanism will now be described in detail. This slit-cleaning mechanism comprises a cleaning member, a removable mechanism for pushing the cleaning member onto a slit, a scanning mechanism for moving the cleaning member in a main scanning direction in the slit, a cleaning member rotating mechanism for rotating the cleaning member in spiral, and a cleaning member storage section for storing the cleaning member. The cleaning member is shaped like, for example, a hollow cylinder. Material having elasticity and a comparatively small coefficient of friction with the slit member such as silicone resin or Teflon sponge is attached to side of the cylinder. The cleaning member can be so structured that it may be exchanged with another or that only the material on the side of the cylinder may be exchanged with another. The removable mechanism pushes the cleaning member onto the slit such that the surface of the cleaning member extends parallel to the surface of the slit. The pressure applied to the cleaning member during the wiping process is set at such a value that the cleaning member is forced into the slit by a distance nearly equal to the width of the slit. Upon completion of every wiping process, the hollow cylindrical cleaning member rotates through 60° in spiral around its axis, exposing a new cleaning surface. When the cleaning member rotates through 360°, it slides from its initial position for a distance about five times the width of the slit. Once used at its all side, the cleaning member is replaced by a new one. The cleaning member rotating mechanism may be located at the scanning mechanism or at the cleaning member storage section. The storage section is provided for preventing alteration of the member which may be caused by paper dust or dust in air or an external factor such as ultraviolet rays. The storage section automatically stores the cleaning member if the member remains unused for a long time.

The means for changing the volume of the ink-holding section is constituted by a piezoelectric element adhered to the wall of the ink-holding section. Alternatively, the means may be constituted by the piezoelectric element which functions as an ink-droplet dividing mechanism of slit jet recording apparatus. The piezoelectric element of the means for changing the volume of the ink-holding section must cause large volume changes, while the piezoelectric element used as the ink-droplet dividing mechanism must respond fast. Hence, they are not suitable for each other's use. In view of this, it is desirable that two independent mechanisms be provided. More specifically, it is desirable that one piezoelectric element for the volume-changing means be mounted on one side of the wall of the ink-holding section and be nearly as large as that side of the wall.

Preferably, the cleaning mechanism performs wiping in sequence, each time with a new cleaning surface in one direction, after about 10 paper sheets have been printed and before the apparatus starts printing data after a long pause. The frequency of wiping is set automatically. It is preferable, however, that it be interactively set at any value according to user desires.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A recording apparatus comprising:

an ink-holding section, having a common opening section for ejecting ink;

a plurality of pixel electrodes located in said ink-holding section and juxtaposed along said common opening section, for ejecting ink;

at least one common electrode opposing said common opening section, for imparting a potential difference to said pixel electrodes; and control means for controlling the potential of each of said pixel electrodes to shift an ink-ejection position along said common opening section or to change an ink-ejection direction along said common opening section.

2. The recording apparatus according to claim 1, wherein said control means has a pulse generator for generating a voltage having a plurality of phases and applying the voltage to each of said pixel electrodes.

3. The recording apparatus according to claim 1, wherein said control means has pressure-applying means for applying a pressure to render an ink meniscus convex, in preparation for ink ejection.

4. The recording apparatus according to claim 3, wherein said pressure-applying means has a piezoelectric element.

5. The recording apparatus according to claim 1, wherein said control means has a plurality of light-generating means, each provided for one pixel electrode, for generating light in accordance with a data signal, and a plurality of photoconductive means, each for receiving light generated by one light-generating means and supplying one pixel electrode with an electric charge corresponding to the light received.

6. The recording apparatus according to claim 5, further comprising a plurality of reset circuits, each for resetting a voltage of one pixel electrode.

7. A recording apparatus comprising:

an ink-holding section, having a common opening section for ejecting ink;

a plurality of pixel electrodes located in the ink-holding section and juxtaposed along the common opening section, for ejecting ink;

at least one common electrode opposing the common opening section, for imparting a potential difference to the pixel electrodes;

a plurality of auxiliary electrodes located between the common opening section and the common electrode and arranged such that at least one corresponds to one pixel electrode, for imparting an independent potential difference to each of the pixel electrodes; and control means for controlling the potential of each of the pixel electrodes to shift an ink-ejection position along the common opening section or to change an ink-ejection direction along the common opening section.

8. The recording apparatus according to claim 7, wherein said control means has a pulse generator for generating a voltage having a plurality of phases and applying the voltage to each of said auxiliary electrodes.

9. The recording apparatus according to claim 8, wherein said control means has pressure-applying means for applying a pressure to render an ink meniscus convex, in preparation for ink ejection.

10. The recording apparatus according to claim 9, wherein said pressure-applying means has a piezoelectric element.

11. The recording apparatus according to claim 7, wherein said control means has a plurality of light-generating means, each provided for one auxiliary electrode, for generating light in accordance with a data signal, and a plurality of photoconductive means, each for receiving light generated by one light-generating means and supplying one auxiliary electrode with an electric charge corresponding to the light received.

12. The recording apparatus according to claim 11, further comprising a plurality of reset circuits, each for resetting a voltage of auxiliary electrode.

13. The recording apparatus according to claim 12, wherein each of said reset circuits has a thin-film transistor.

14. The recording apparatus according to claim 7, wherein said control means has a plurality of heat-generating means, each provided for one auxiliary electrode, for generating heat in accordance with a data signal, and a plurality of pyroelectric member, each for receiving heat generated by one heat-generating means and supplying one auxiliary electrode with an electric charge corresponding to the heat received.

15. The recording apparatus according to claim 14, wherein said each of said pyroelectric means is made of an inorganic pyroelectric material.

16. The recording apparatus according to claim 14, wherein each of said heat-generating means has a thermal printer head driver and a heat-generating resistor for generating heat from power supplied from the thermal printer head driver.

17. The recording apparatus according to claim 14, further comprising a plurality of reset circuits, each for resetting a voltage of auxiliary electrode.

18. The recording apparatus according to claim 17, wherein each of said reset circuits has thin-film transistor.

19. The recording apparatus according to claim 17, wherein each of said reset circuits has a photosensitive element and a light source.

20. The recording apparatus according to claim 17, wherein each of said reset circuits has an ion source.

21. The recording apparatus according to claim 14, further comprising a control circuit for controlling a difference between voltages applied to said auxiliary electrodes.

22. The recording apparatus according to claim 17, wherein said ink-holding section has an internal partition member dividing an interior of said ink-holding section to two sections extending parallel to said common opening section, a plurality of ink-stream generating nozzles formed in those portions of the partition member which corresponds to said pixel electrodes, and pressure-applying means for applying a pressure on the ink contained in said ink-holding section, to thereby periodically eject the ink through the ink-stream generating nozzles.

23. A recording apparatus comprising:

imparting an ink-holding section, having a common opening section for ejecting ink;

a plurality of pixel electrodes located in said ink-holding section and juxtaposed along said common opening section;

at least one common electrode opposing said common opening section, for imparting a potential difference to the pixel electrodes; and a plurality of auxiliary electrodes located between said common opening section and said common electrode and arranged such that at least one corresponds to one pixel electrode, for an independent potential difference to each of said pixel electrodes.

* * * * *